US010745987B2

(12) United States Patent
Werries et al.

(10) Patent No.: US 10,745,987 B2
(45) Date of Patent: Aug. 18, 2020

(54) APPARATUSES AND METHODS FOR LOCATING WITHIN A WELLBORE

(71) Applicant: NCS MULTISTAGE INC., Calgary (CA)

(72) Inventors: Michael Werries, Calgary (CA); Juan Montero, Calgary (CA)

(73) Assignee: NCS Multistage Inc., Calgary (CA)

( * ) Notice: Subject to any disclaimer, the term of this patent is extended or adjusted under 35 U.S.C. 154(b) by 22 days.

(21) Appl. No.: 15/348,867

(22) Filed: Nov. 10, 2016

(65) Prior Publication Data

US 2017/0183929 A1 Jun. 29, 2017

Related U.S. Application Data

(60) Provisional application No. 62/253,448, filed on Nov. 10, 2015, provisional application No. 62/355,063, filed on Jun. 27, 2016, provisional application No. 62/402,505, filed on Sep. 30, 2016.

(51) Int. Cl.
*E21B 23/03* (2006.01)
*E21B 23/02* (2006.01)

(52) U.S. Cl.
CPC ..... *E21B 23/03* (2013.01); *E21B 23/02* (2013.01)

(58) Field of Classification Search
CPC ..... E21B 23/03; E21B 23/02
See application file for complete search history.

(56) References Cited

U.S. PATENT DOCUMENTS

| | | | | |
|---|---|---|---|---|
| 3,080,924 | A | 3/1963 | Baker et al. | |
| 3,130,788 | A | 4/1964 | Cochran et al. | |
| 3,638,723 | A | 2/1972 | Carroll | |
| 4,284,154 | A | 8/1981 | England | |
| 4,722,392 | A * | 2/1988 | Proctor | E21B 23/006 166/217 |
| 5,366,019 | A | 11/1994 | Brooks | |
| 5,687,795 | A | 11/1997 | Patel et al. | |
| 6,827,148 | B2 | 12/2004 | Shaw et al. | |
| 7,284,606 | B2 | 10/2007 | Coronado | |

(Continued)

FOREIGN PATENT DOCUMENTS

| | | |
|---|---|---|
| CA | 2906468 A1 | 3/2016 |
| EP | 0810348 A2 | 12/1997 |
| GB | 2439399 A | 12/2007 |

OTHER PUBLICATIONS

Allen, D. R., Collar and radioactive bullet logging for subsidence monitoring, 1969, SPWLA 10th Annual Logging Symposium, May 25-28, Houston, Texas, Society of Petrophysicists and Well-Log Analysts.

(Continued)

*Primary Examiner* — D. Andrews
(74) *Attorney, Agent, or Firm* — Ridout and Maybee LLP

(57) ABSTRACT

There is provided a locator comprising a wellbore coupler including an engagement member that is biased by a biasing member for becoming disposed in a locating position within a locate profile within a wellbore, and a displacement impeding member for impeding displacement of the engagement member relative to the locate profile, while the engagement member is being supported by the displacement impeder, wherein the displacement is for effecting retraction of the engagement member from the locate profile.

61 Claims, 20 Drawing Sheets

(56) References Cited

U.S. PATENT DOCUMENTS

| | | | | |
|---|---|---|---|---|
| 7,284,608 | B2 | 10/2007 | Reddy et al. | |
| 8,074,713 | B2 | 12/2011 | Ramos et al. | |
| 8,225,869 | B2 | 7/2012 | Beard et al. | |
| 8,267,172 | B2 | 9/2012 | Surjaatmadja et al. | |
| 8,312,925 | B2 | 11/2012 | Trummer et al. | |
| 8,607,860 | B2 | 12/2013 | Avant et al. | |
| 8,794,331 | B2 | 8/2014 | Getzlaf et al. | |
| 9,217,316 | B2 | 12/2015 | Ehtesham et al. | |
| 2004/0149452 | A1 | 8/2004 | Pendleton | |
| 2006/0081380 | A1 | 4/2006 | Hoffman et al. | |
| 2006/0225878 | A1 | 10/2006 | Coronado | |
| 2009/0078413 | A1 | 3/2009 | Tubel et al. | |
| 2012/0279709 | A1 | 11/2012 | Bain et al. | |
| 2013/0161027 | A1 | 6/2013 | Inglis et al. | |
| 2013/0168099 | A1 | 7/2013 | Themig | |
| 2013/0333883 | A1* | 12/2013 | Ehtesham | E21B 43/00 166/255.1 |
| 2015/0075788 | A1 | 3/2015 | O'Brien et al. | |
| 2015/0075815 | A1 | 3/2015 | O'Brien et al. | |
| 2015/0152725 | A1 | 6/2015 | Thomas et al. | |
| 2016/0047189 | A1 | 2/2016 | MacLeod et al. | |
| 2016/0090803 | A1 | 3/2016 | Getzlaf et al. | |

OTHER PUBLICATIONS

General Electric Company, Casting Collar Locators (CCL)—Wireline Systems| GE Energy, http://www.ge-energy.com/products_and_services/products/wireline_systems/casing_collar_locator.jsp, retrieved Aug. 21, 2014.

Connell et al., High-Pressure/High-Temperature Coiled Tubing Casing Collar Locator Provides Accurate Depth Control for Single-Trip Perforating, 2000, SPE/ICoTA Coiled Tubing Roundtable, Apr. 5-6, Houston, Texas, Society of Petroleum Engineers.

Caldwell et al. Plug locator system mitigates cement plug displacement risks, Mar. 18, 2013, http://www.drillingcontractor.org/plug-locator-system-mitigates-cement-plug-displacement-risks-21240, retrieved on May 27, 2016.

Gay, Jennifer Hawkins—United States Patent and Trademark Office, "Office Action" for corresponding U.S. Appl. No. 14/867,726 dated Oct. 24, 2017.

Wilkison, Sean—Canadian Intellectual Property Office, "Written Opinion and International Search Report" for corresponding PCT Application No. PCT/CA2016/000278 dated Feb. 9, 2017.

WIPO, International Search Report and Written Opinion for PCT Application No. PCT/CA2016/000278 dated Feb. 9, 2017.

* cited by examiner

DETAIL A

DETAIL B

DETAIL C

DETAIL D

DETAIL E

DETAIL G

A
344
348
341
342
300
350
350
344
356
354
336
338
346
314
330
A
304
316A
316
306
3062
302
310
301
A 350
352
358

340
342
350
334
346
332
332
330
301
301B 342
350
332
330
314
202
200
316A
316
306
3062
304
308

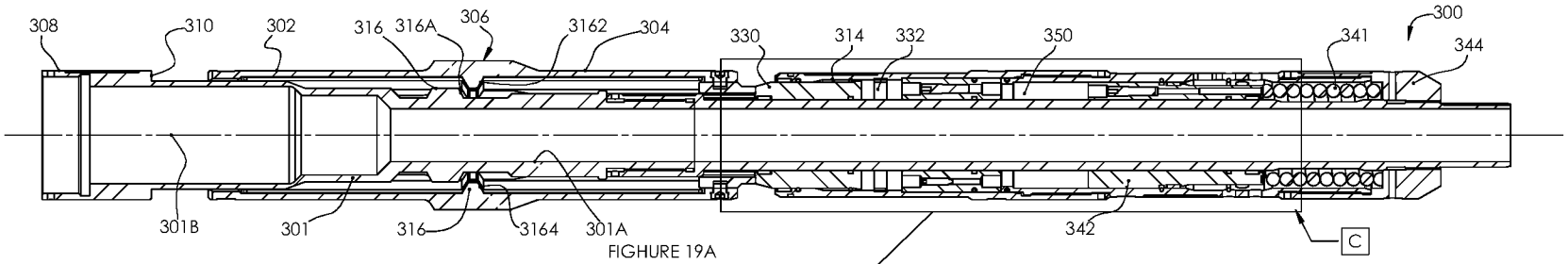
FIGHURE 19A
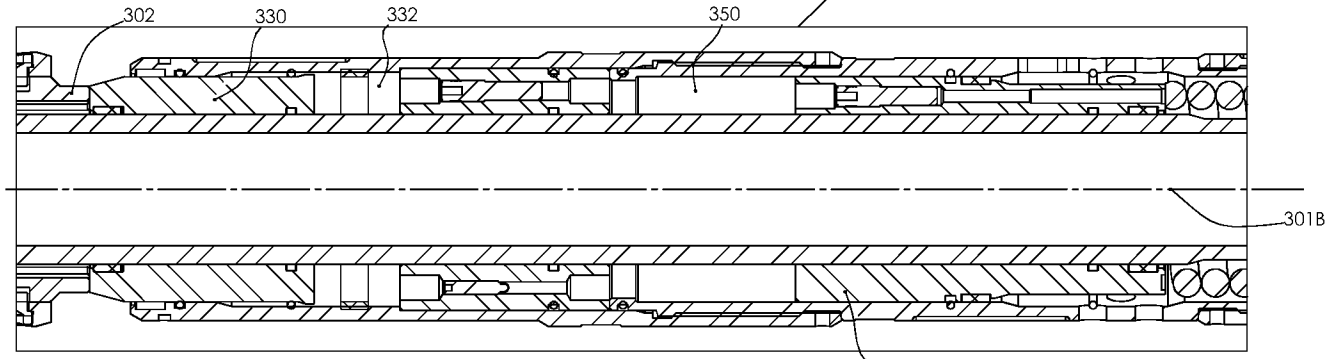
FIGHURE 19B
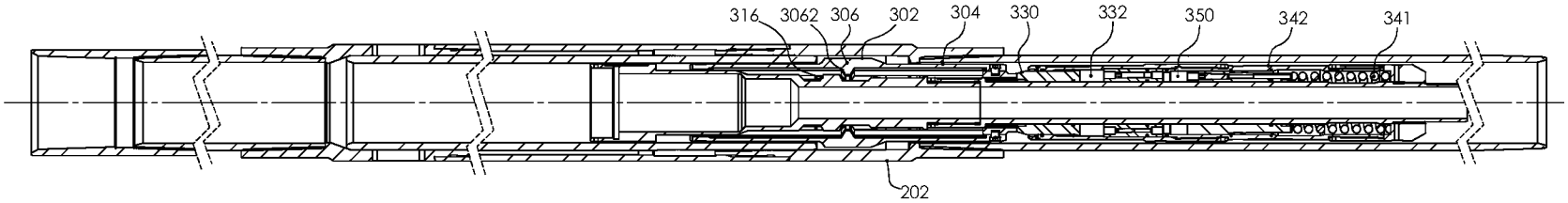
FIGHURE 19C 300
301B
341
D
342
350
332
314
330
304
3062
316A
306
301A
301
316
304
310
308

341
342
350

330
202
3062
306
304
302
316

341
342
350
332
314
330
202
3062
306
316
302
E
310
304

APPARATUSES AND METHODS FOR LOCATING WITHIN A WELLBORE

CROSS-REFERENCE TO RELATED APPLICATIONS

The application claims the benefits of priority to U.S. Provisional Patent Application No. 62/253,448, filed Nov. 10, 2015, U.S. Provisional Patent Application No. 62/355,063, filed on Jun. 27, 2016, titled and U.S. Provisional Patent Application No. 62/402,505, filed on Sep. 30, 2016. The contents of the above-referenced applications are incorporated into the present application by reference.

FIELD

The present disclosure relates to locators for effecting positioning of tools within a wellbore.

BACKGROUND

It is often desirable to position a tool within a wellbore in order to perform a wellbore operation, such as perforating a casing, or sliding a sleeve for opening and closing a port in order to effect hydraulic fracturing and, subsequently, to receive hydrocarbons from a reservoir.

Contemporary wells often extend over significant distances and may be characterized by signficant deviation. In order for a locator to be positioned at or near the extremities of such wells, the locator is configured so as not to offer significant resistance while it is being deployed downhole. However, with a conventional locator, in minimizing its frictional resistance, the reliability of a locator in locating a wellbore, and enabling proper positioning of a tool for a downhole operation, suffers. This is because successful locating is often indicated by sensed resistance to overpull applied to the workstring, and there is greater risk that overpull, in circumstances where the locator is configured to offer minimal resistance while travelling though the well, may be confused with other forces that are merely dislodging the workstring from another form of interference within the wellbore. This is especially true for extended reach wells.

SUMMARY

In one aspect, there is provided a locator comprising: a wellbore coupler including an engagement member that is biased by a biasing member for becoming disposed in a locating position within a locate profile within a wellbore; and a displacement impeding member for impeding displacement of the engagement member relative to the locate profile, while the engagement member is being supported by the displacement impeder, wherein the displacement is for effecting retraction of the engagement member from the locate profile.

In another aspect, there is provided a locator comprising: a wellbore coupler including an engagement member that is biased towards a locating position for disposition within a locate profile, and configured for displacement between the locating position and a retracted position; and a displacement hindering member for preventing displacement of the engagement member to the retracted position; wherein the engagement member and the displacement hindering member are co-operatively configured such that at least one of the engagement member and the displacement hindering member is displaceable relative to the other one of the engagement member and the displacement hindering member, while the displacement of the engagement member to the retracted position is being prevented, for effecting a change in condition of the engagement member such that the engagement member becomes displaceable to the retracted position.

In another aspect, there is provided a locator comprising: a wellbore coupler including an engagement member that is biased towards a locating position for disposition within a locate profile, and configured for displacement between the locating position and a retracted position; and a displacement hindering member for impeding displacement of the engagement member to the retracted position; wherein the engagement member and the displacement hindering member are co-operatively configured such that the engagement member and the displacement hindering member are displaceable relative to one another, while the displacement of the engagement member to the retracted position is being impeded, for effecting a change in condition of the engagement member such that the engagement member becomes displaceable to the retracted position.

In another aspect, there is provided a locator comprising: a wellbore coupler including an engagement member that is biased towards a locating position for disposition within a locate profile, and configured for displacement between the locating position and a retracted position; and a displacement hindering member for opposing displacement of the engagement member to the retracted position; wherein the engagement member and the displacement hindering member are co-operatively configured such that the engagement member and the displacement hindering member are displaceable relative to one another, while the displacement of the engagement member to the retracted position is being opposed, for effecting a change in condition of the engagement member such that the engagement member becomes displaceable to the retracted position.

In another aspect, there is provided a system for producing hydrocarbon-comprising material from a subterranean formation via a wellbore extending into the subterranean formation, comprising: a wellbore string disposed within the wellbore, wherein the wellbore string includes a locate profile; a workstring, deployed within the wellbore, and including any of the embodiments of the locator described above, wherein the engagement member is configured for disposition within the locate profile of the wellbore string.

In another aspect, there is provided a method of performing a wellbore operation comprising: positioning a tool within the wellbore with any of the embodiments of the locator described above, wherein the positioning includes effecting releasable retention of the engagement member within a predetermined locate profile of the wellbore; and after the positioning, actuating the tool for performing the wellbore operation.

BRIEF DESCRIPTION OF DRAWINGS

The preferred embodiments will now be described with the following accompanying drawings, in which:

FIG. 19A is a sectional view of the fourth embodiment of the locator, having been deployed within a wellbore and disposed in a pull-out-of-hole ("POOH") condition, but further uphole relate to the condition of the locator in FIG. 18A, with the locator block still being releasably engaged to the locate profile and the collet protuberance having become unseated from the keeper;

FIG. 19B is an enlarged view of Detail "C" in FIG. 19A;

FIG. 19C is an identical view of the locator in FIG. 19A, as deployed within a wellbore string;

DETAILED DESCRIPTION

Figures 1A, 1B:
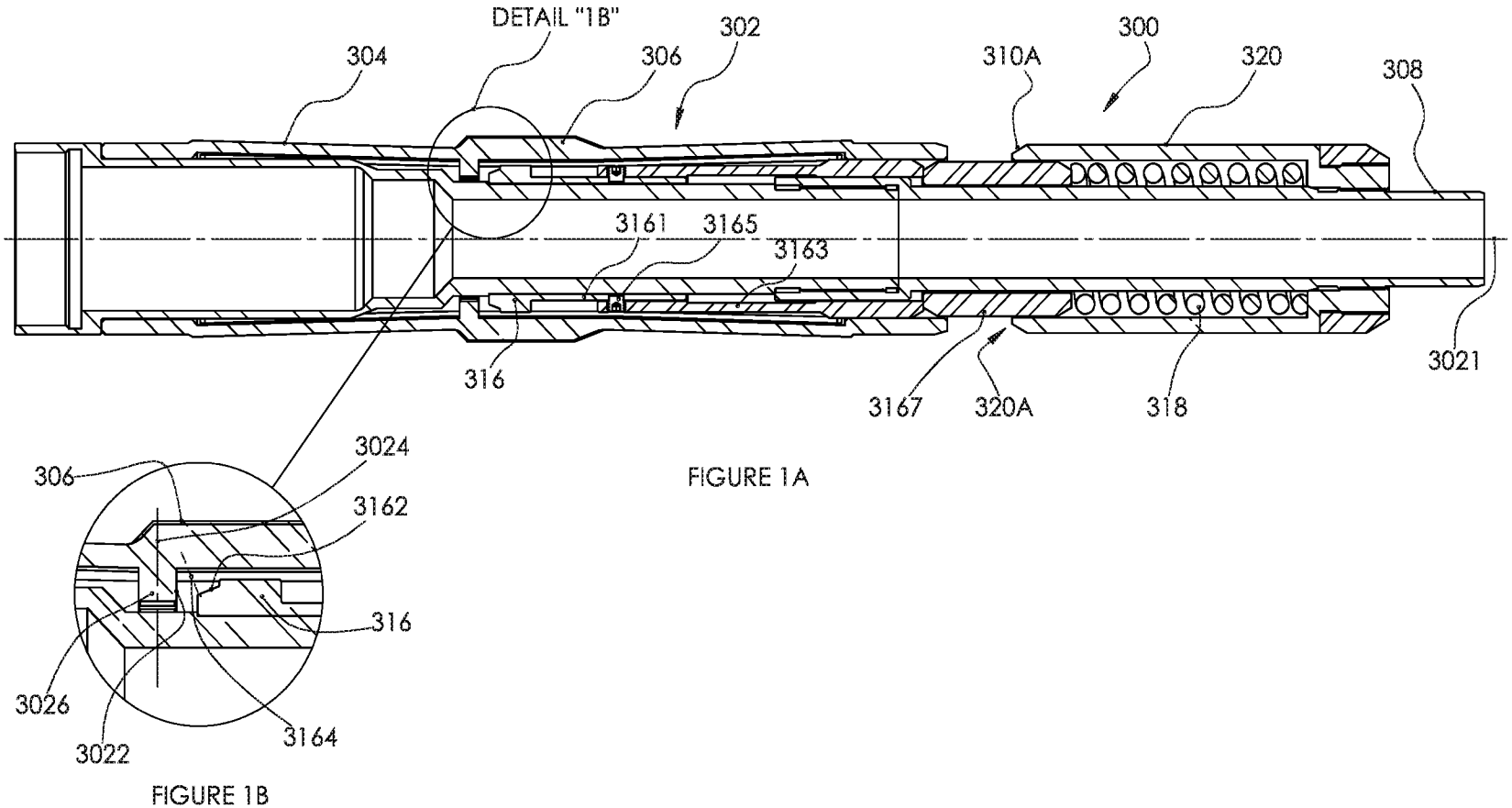
FIG. 1A is a sectional view of a first embodiment of a locator disposed in a condition while being run-in-hole within a wellbore.
FIG. 1B is an enlarged view of Detail "1B" in FIG. 1A.
Figures 2A, 2B:
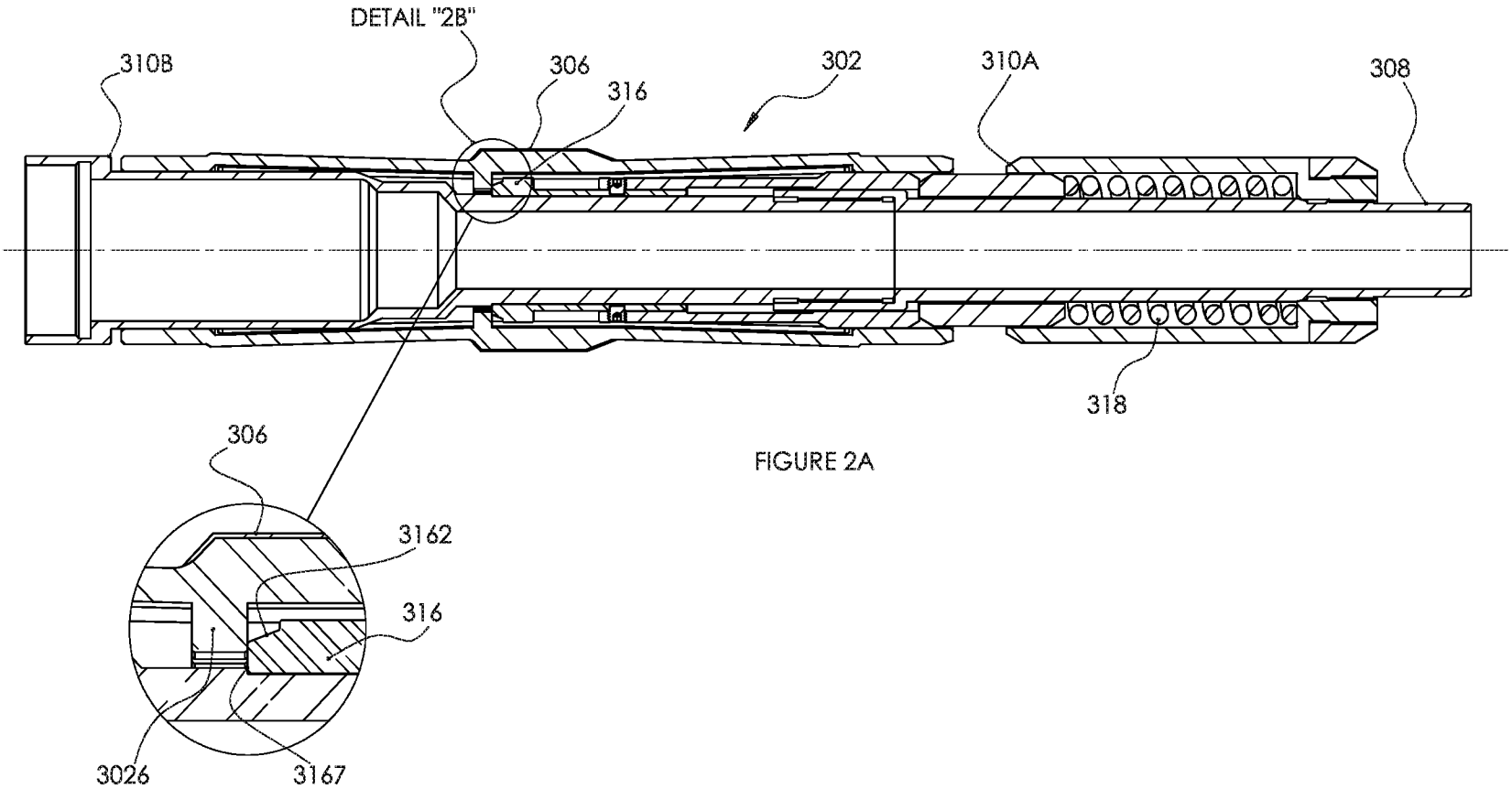
FIG. 2A is a sectional view of the first embodiment of a locator disposed in a condition while being pulled-out-of-hole within a wellbore, and while the wellbore coupler is disposed in a released position.
FIG. 2B is an enlarged view of Detail "2B" in FIG. 2A.

Referring to FIGS. 1 to 17D, a locator 300 is provided. In some embodiments, for example, the locator 300 includes a conveyance member 301. In some embodiments, for example, the conveyance member 301 includes a mandrel 301A. The conveyance member 301 is configured for coupling to a workstring 220. The workstring 220 is deployable within a wellbore 102 that extends into a subterranean formation 100. In this respect, the conveyance member 301 is translatable with the workstring 220 and is, therefore, moveable through the wellbore 102 in response to a force being applied to the workstring 220. Concomitantly, the locator 300 is moveable through the wellbore 102 in response to a force being applied to the workstring 220.

The locator 300 includes a wellbore coupler 302. The wellbore coupler 302 includes an engagement member 306, and the engagement member 306 includes a protuberance, such as a locator block 306A. The engagement member 306 is provided for becoming releasably retained (such as, for example, via the locator block 306A) by a wellbore feature 202 (such as, for example, a locate profile 202 defined within a wellbore string, such as, for example, casing string) within a wellbore 102. The releasable retention is such that relative displacement between the locator 300 and the locate profile 202 (or other wellbore feature), such as along an axis that is parallel, or substantially parallel, to the central longitudinal axis of the wellbore 102, is at least impeded. In some embodiments, for example, the engagement member 306 extends outwardly relative to the central longitudinal axis of the conveyance member 301.

In some embodiments, for example, the locator block 306A is sufficiently large such that inadvertent locating of the locator block 306A within a recess of the wellbore 102 (such as a recess within the wellbore string 200, for example, a casing string), other than the locate profile 202, is avoided.

The engagement member 306 is biased towards a locating position, and is displaceable, relative to the mandrel 308, between the locating position and a retracted position. While releasably retained by the locate profile 202, the engagement member 306 is disposed in the locating position. After having become released from retention by the locate profile 202, the engagement member 306 is disposed in the retracted position. In some embodiments, for example, the displaceability of the engagement member 306 from the retracted position to the locating position is outwardly relative to the central longitudinal axis of the wellbore 102, or the central longitudinal axis of the conveyance member 301, or both, and the displaceability of the engagement member 306 from the locating position to the retracted position is inwardly relative to the central longitudinal axis of the wellbore 102, or the central longitudinal axis 301B of the conveyance member 301, or both.

In some embodiments, for example, the wellbore coupler 302 includes one or more resilient members that exert a biasing force for effecting the biasing of the locator block 306A to the locating position. In some embodiments, for example, the resilient members 304 are in the form of collet springs (for example, beam springs), that are separated by slots. In some contexts, the collet springs 304 may be referred to as collet fingers. In some embodiments, for example, a locator block 306A is disposed on one or more of the collet springs 304. In some embodiments, for example, the locator block 306A is defined as a protuberance extending from the collet spring 304.

In some embodiments, for example, the collet springs 304 are configured for a limited amount of compression in response to a compressive force applied inwardly relative to a longitudinal axis of the mandrel. Because of their resiliency, the collet springs 304 are able to pass by a restriction in a wellbore 102 while returning to its original shape.

In this respect, when the locator block 306A becomes aligned with the locate profile 202, after traversing a portion of the wellbore 102 while in a compressed state, the collet springs 304 expand such that the locator block 306A is displaced outwardly relative to the central longitudinal axis of wellbore 102, towards the locate profile 202, for disposition in the locating position such that the locator block 306A becomes releasably retained by the locate profile 202.

Co-operatively, the locate profile 202 is shaped (for example, tapered inwardly towards the central longitudinal axis of the wellbore 102, such as, for example, at its uphole end) so as to encourage the displacement of the locator block 306A from the locate profile 202 (i.e. displacement of the engagement member 306 from the locating position to the retracted position). In some embodiments, for example, the locate profile 202 is tapered, at its uphole end, at an angle of between 40 degrees and 90 degrees relative to the longitudinal axis of the wellbore 102. In some embodiments, for example, comparatively, the locate profile 202 is tapered at its downhole end at an angle of between 5 degrees and 90 degrees relative to the longitudinal axis of the wellbore 102. In this respect, the force required to release the engagement member 306 from retention by the locate profile 302 is relatively less while the locator 300 is being run-in-hole than while the locator 300 is being pulled up-hole. By configuring the locate profile 202 in this manner, the locate profile 202 does not significantly impede the running-in-hole of the locator 300, while being available to releasably retain the engagement member 306 as the locator 300 is being pulled-out-of hole and contribute to withstanding such release until a sufficient force, that is noticeable at the surface, is applied to the engagement member 306.

In one aspect, the locator 300 includes a displacement hindering member 316 for preventing the displacement of the engagement member 306.

The displacement hindering member 316 is configured for preventing (such as, for example, blocking) the displacement of the engagement member 306 from the locating position (such as, for example, while the engagement member 306 disposed within a locate profile 202, such as, for example, while the engagement member 306 is being releasably retained by the locate profile 202) to the retracted position (such as, for example, while the engagement member 306 is released from retention by the locate profile 202).

In some embodiments, for example, the preventing of the displacement includes opposing of the displacement. In some embodiments, the preventing of the displacement is being effected while the engagement member 306 is disposed in the locating position. In some embodiments, for example, the preventing of the displacement is being effected while the engagement member 306 is supported by the displacement hindering member 316. In some embodiments, for example, the preventing of the displacement is being effected while the wellbore coupler 302 is engaged to the displacement hindering member 316. In some embodiments, for example, the wellbore coupler 302 is seated on the displacement hindering member 316 while the wellbore coupler 302 is engaged to the displacement hindering member.

At least one of the engagement member 306 and the displacement hindering member 316 is displaceable relative to the other one of the engagement member 306 and the displacement hindering member 316, while the displacement of the engagement member 306 to the retracted position is being prevented, for effecting a change in condition of the engagement member 306 such that the engagement member 306 becomes displaceable to the retracted position.

In this respect, in some embodiments, for example, the displacement hindering member 316 is displaceable relative to the engagement member 306, while the displacement of the engagement member 306 to the retracted position is being prevented, for effecting a change in condition of the engagement member 306 such that the engagement member 306 becomes displaceable to the retracted position. In some embodiments, for example, the engagement member is displaceable relative to the displacement hindering member 316, while the displacement of the engagement member 306 to the retracted position is being prevented, for effecting a change in condition of the engagement member 306 such that the engagement member 306 becomes displaceable to the retracted position. In some embodiments, for example, the displacement hindering member 316 is displaceable relative to the engagement member 306, and engagement member is displaceable relative to the displacement hindering member 316, while the displacement of the engagement member 306 to the retracted position is being prevented, for effecting a change in condition of the engagement member 306 such that the engagement member 306 becomes displaceable to the retracted position.

In some embodiments, for example, the effecting a change in condition of the engagement member 306 includes defeating the preventing of the displacement. In some embodiments, for example, the effecting a change in condition of the engagement member 306 includes effecting positioning of the engagement member 306 relative to the displacement hindering member 316 such that there is an absence, or substantial absence, of interference to the displacement of the engagement member 306, by the displacement hindering member 316, to the retracted position. In some embodiments, for example, the effecting a change in condition of the engagement member 306 includes effecting positioning of the engagement member 306 relative to the displacement hindering member 316 such that there is an absence, or substantial absence, of opposition to the displacement of the engagement member 306, by the displacement hindering member 316, to the retracted position. In some embodiments, for example, the effecting a change in condition of the engagement member 306 includes effecting positioning of the engagement member 306 relative to the displacement hindering member 316 such that there is an absence, or substantial absence, of supporting of the engagement member 306 by the displacement hindering member 316. In some embodiments, for example, the effecting a change in condition of the engagement member 306 includes effecting positioning of the engagement member 316 relative to the displacement hindering member 306 such that there is an absence, or substantial absence, of engagement of the engagement member 306 by the displacement hindering member 316. In some embodiments, for example, the preventing displacement is being effected while the engagement member 306 is seated on the displacement hindering member 316; and the effecting a change in condition of the engagement member 306 such that the engagement member 306 becomes displaceable to the retracted position, for which the engagement member 306 and the displacement hindering member 316 are displaceable relative to one another while the displacement of the engagement member 306 to the retracted position is being prevented, includes effecting the unseating of the engagement member 306 relative to the displacement hindering member 316.

In some embodiments, for example, the displaceability of at least one of the engagement member 306 and the displacement hindering member 316, relative to the other one of the engagement member 306 and the displacement hindering member 316, while the displacement of the engagement member 306 to the retracted position is being prevented, for effecting a change in condition of the engagement member 306 such that the engagement member 306 becomes displaceable to the retracted position, is effected by displaceability of the at least one of the engagement member 306 and the displacement hindering member 316 relative to the other one of the engagement member 306 and the displacement hindering member 316 along an axis that is transverse (such as, for example, orthogonal or substantially orthogonal) to the axis 3024 along which the engagement member 306 is displaceable between the locating and retracted positions. In some embodiments, for example, the displaceability of the at least one of the engagement member 306 and the displacement hindering member 316 relative to the other one of the engagement member 306 and the displacement hindering member 316 is along an axis that is parallel, or substantially parallel, to the central longitudinal axis 301B of the conveyance member 301.

In some embodiments, for example, the displaceability, of at least one of the engagement member 306 and the displacement hindering member 316, relative to the other one of the engagement member 306 and the displacement hindering member 316, while the displacement of the engagement member 306 to the retracted position is being prevented, for effecting a change in condition of the engagement member 306 such that the engagement member 306 becomes displaceable to the retracted position, is effected by displaceability of the displacement hindering member 316 relative to the engagement member 306. In this respect, in some embodiments, for example, the displacement hindering member 316 is displaceable relative to the engagement member 306, while the displacement of the engagement member 306 to the retracted position is being prevented, for effecting a change in condition of the engagement member 306 such that the engagement member 306 becomes displaceable to the retracted position. In some embodiments, for example, the displaceability of the displacement hindering member 316 relative to the engagement member 306 is along an axis that is transverse to the axis 3024 along which the engagement member 306 is displaceable between the locating and retracted positions. In some embodiments, for example, the displaceability of the displacement hindering member 316 relative to the engagement member 306 is along an axis that is orthogonal, or substantially orthogonal, to the axis 3024 along which the engagement member 306 is displaceable between the locating and retracted positions. In some embodiments, for example, the displaceability of the displacement hindering member 316, relative to the engagement member, is along an axis that is parallel, or substantially parallel, to the central longitudinal axis 301 of the conveyance member 301. In some embodiments, for example, the engagement member 306 is non-displaceable, or substantially non-displaceable, relative to the axis along which the engagement member 306 is displaceable between the locating and retracted positions.

In another aspect, the locator 300 includes a displacement hindering member 316 for impeding the displacement of the engagement member 306.

The displacement hindering member 316 is configured for impeding the displacement of the engagement member 306 from the locating position (such as, for example, while the engagement member 306 disposed within a locate profile 202, such as, for example, while the engagement member 306 is being releasably retained by the locate profile 202) to the retracted position (such as, for example, while the engagement member 306 is released from retention by the locate profile 202).

In some embodiments, for example, the impeding of the displacement includes opposing of the displacement. In some embodiments, the impeding of the displacement is being effected while the engagement member 306 is disposed in the locating position. In some embodiments, for example, the impeding of the displacement is being effected while the engagement member 306 is supported by the displacement hindering member 316. In some embodiments, for example, the impeding of the displacement is being effected while the wellbore coupler 302 is engaged to the displacement hindering member 316. In some embodiments, for example, the wellbore coupler 302 is seated on the displacement hindering member 316 while the wellbore coupler 302 is engaged to the displacement hindering member.

At least one of the engagement member 306 and the displacement hindering member 316 is displaceable relative to the other one of the engagement member 306 and the displacement hindering member 316, while the displacement of the engagement member 306 to the retracted position is being impeded, for effecting a change in condition of the engagement member 306 such that the engagement member 306 becomes displaceable to the retracted position. In this respect, in some embodiments, for example, the displacement hindering member 316 is displaceable relative to the engagement member 306, while the displacement of the engagement member 306 to the retracted position is being impeded, for effecting a change in condition of the engagement member 306 such that the engagement member 306 becomes displaceable to the retracted position. In some embodiments, for example, the engagement member is displaceable relative to the displacement hindering member 316, while the displacement of the engagement member 306 to the retracted position is being impeded, for effecting a change in condition of the engagement member 306 such that the engagement member 306 becomes displaceable to the retracted position. In some embodiments, for example, the displacement hindering member 316 is displaceable relative to the engagement member 306, and the engagement member 306 is displaceable relative to the displacement hindering member 316, while the displacement of the engagement member 306 to the retracted position is being impeded, for effecting a change in condition of the engagement member 306 such that the engagement member 306 becomes displaceable to the retracted position.

In some embodiments, for example, the effecting a change in condition of the engagement member 306 includes defeating the impeding of the displacement. In some embodiments, for example, the effecting a change in condition of the engagement member 306 includes effecting positioning of the engagement member 306 relative to the displacement hindering member 316 such that there is an absence, or substantial absence, of interference to the displacement of the engagement member 306, by the displacement hindering member 316, to the retracted position. In some embodiments, for example, the effecting a change in condition of the engagement member 306 includes effecting positioning of the engagement member 306 relative to the displacement hindering member 316 such that there is an absence, or substantial absence, of opposition to the displacement of the engagement member 306, by the displacement hindering member 316, to the retracted position. In some embodiments, for example, the effecting a change in condition of the engagement member 306 includes effecting positioning of the engagement member 306 relative to the displacement hindering member 316 such that there is an absence, or substantial absence, of supporting of the engagement member 306 by the displacement hindering member 316. In some embodiments, for example, the effecting a change in condition of the engagement member 306 includes effecting positioning of the engagement member 316 relative to the displacement hindering member 306 such that there is an absence, or substantial absence, of engagement of the engagement member 306 by the displacement hindering member 316. In some embodiments, for example, the impeding displacement is being effected while the engagement member 306 is seated on the displacement hindering member 316; and the effecting a change in condition of the engagement member 306 such that the engagement member 306 becomes displaceable to the retracted position, for which the engagement member 306 and the displacement hindering member 316 are displaceable relative to one another while the displacement of the engagement member 306 to the retracted position is being impeded, includes effecting the unseating of the engagement member 306 relative to the displacement hindering member 316.

In some embodiments, for example, the displaceability of at least one of the engagement member 306 and the displacement hindering member 316, relative to the other one of the engagement member 306 and the displacement hindering member 316, while the displacement of the engagement member 306 to the retracted position is being impeded, for effecting a change in condition of the engagement member 306 such that the engagement member 306 becomes displaceable to the retracted position, is effected by displaceability of the at least one of the engagement member 306 and the displacement hindering member 316 relative to the other one of the engagement member 306 and the displacement hindering member 316 along an axis that is transverse (such as, for example, orthogonal or substantially orthogonal) to the axis 3024 along which the engagement member 306 is displaceable between the locating and retracted positions. In some embodiments, for example, the displaceability of the at least one of the engagement member 306 and the displacement hindering member 316 relative to the other one of the engagement member 306 and the displacement hindering member 316 is along an axis that is parallel, or substantially parallel, to the central longitudinal axis 301 of the conveyance member 301.

In some embodiments, for example, the displaceability, of at least one of the engagement member 306 and the displacement hindering member 316, relative to the other one of the engagement member 306 and the displacement hindering member 316, while the displacement of the engagement member 306 to the retracted position is being impeded, for effecting a change in condition of the engagement member 306 such that the engagement member 306 becomes displaceable to the retracted position, is effected by displaceability of the displacement hindering member 316 relative to the engagement member 306. In this respect, in some embodiments, for example, the displacement hindering member 316 is displaceable relative to the engagement member 306, while the displacement of the engagement member 306 to the retracted position is being impeded, for effecting a change in condition of the engagement member 306 such that the engagement member 306 becomes displaceable to the retracted position. In some embodiments, for example, the displaceability of the displacement hindering member 316 relative to the engagement member 306 is along an axis that is transverse to the axis along which the engagement member 306 is displaceable between the locating and retracted positions. In some embodiments, for example, the displaceability of the displacement hindering member 316 relative to the engagement member 306 is along an axis that is orthogonal, or substantially orthogonal, to the axis along which the engagement member 306 is displaceable between the locating and retracted positions. In some embodiments, for example, the displaceability of the displacement hindering member 316, relative to the engagement member, is along an axis that is parallel, or substantially parallel, to the central longitudinal axis of the conveyance member 301. In some embodiments, for example, the engagement member 306 is non-displaceable, or substantially non-displaceable, relative to the axis along which the engagement member 306 is displaceable between the locating and retracted positions.

In some embodiments, for example, the displaceability of the engagement member 306, between the locating and retracted positions, is along an axis that is transverse to the central longitudinal axis of the conveyance member 301. In some embodiments, for example, the displaceability of the engagement member 306, between the locating to the retracted position, is along an axis 3024 that is orthogonal, or substantially orthogonal, to the central longitudinal axis 301 of the conveyance member 301. In some embodiments, for example, the displaceability of the engagement member 306, from the locating to the retracted position, is inwardly towards the central longitudinal axis 301 of the conveyance member, and the displaceability of the engagement member 306, from the locating to the retracted position, is outwardly relative the central longitudinal axis of the conveyance member. In some embodiments, for example, the engagement member 306 is non-displaceable, or substantially non-displaceable, relative to the axis 3024 along which the engagement member 306 is displaceable between the locating and retracted positions.

Referring to the embodiments illustrated in FIGS. 1 to 10, in some embodiments, for example, the preventing or impeding of the displacement of the displacement hindering member 316, relative to the engagement member 306, is effected mechanically.

In some embodiments, for example, in being conveyed through the wellbore 102, the wellbore coupler 302 is slidably mounted over the conveyance member 301. In some embodiments, for example, the conveyance member 301 includes wellbore coupler retainer members 310A, 310B (such as, for example, in the form of collars 310A, 310B) for engaging the wellbore coupler 302, and thereby limiting displacement of the wellbore coupler 302 relative to the conveyance member 301.

The wellbore coupler retainer member 310A transmits an uphole pulling force, being applied to the conveyance member 301, from the conveyance member 301 to the wellbore coupler 302. In some embodiments, for example, the wellbore coupler retainer member 310A is defined by a terminal end 320A of the housing 320. The transmission of such an uphole pulling force effects displacement of the wellbore coupler 302 along an axis that is parallel, or substantially parallel, to the central longitudinal axis of the wellbore 102, along an axis that is parallel, or substantially parallel, to the central longitudinal axis of the conveyance member 301, or both. As well, while the engagement member 306 is releasably retained within the locate profile 202, the transmission of such an uphole pulling force effects displacement of the wellbore coupler from the locating position to the retracted position such that the engagement member 306 becomes released from the locate profile 202.

Figures 5A, 5B:
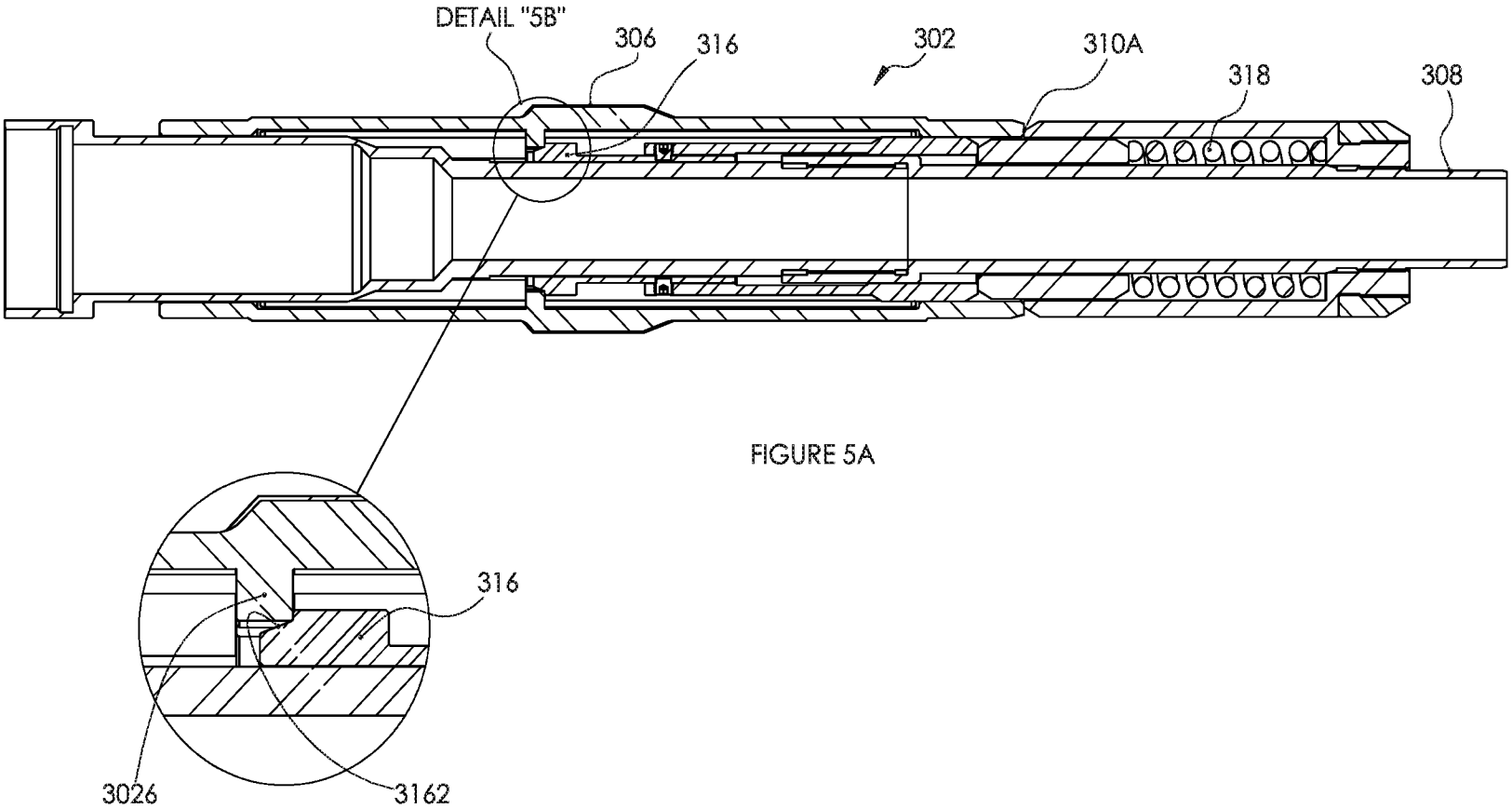
FIG. 5A is a sectional view of the first embodiment of a locator disposed in a condition while being pulled-out-of-hole within a wellbore, and while: (i) the engagement member of the wellbore coupler is disposed in the locating position, (ii) the mandrel is applying a force urging displacement of the engagement member to the retracted position, and (iii) the displacement hindering member is preventing such displacement.
FIG. 5B is an enlarged view of Detail "5B" in FIG. 5A.

In this respect, referring to FIG. 5A, urging of the release of the engagement member 306 from the retention by the locate profile 202, that is being prevented or impeded by the displacement hindering member 316, is effected, while: (i) the engagement member 306 is releasably retained by the locate profile 202 and the wellbore coupler 302 is shouldered versus the wellbore coupler retainer member 310A, and (ii) the wellbore coupler retainer member 310A is transmitting an uphole pulling force (being applied to the conveyance member 301, such as via the workstring 220) from the conveyance member 301 to the wellbore coupler 302. In this respect, in some embodiments, for example, the displacement of the engagement member 306 from the locating position to the retracted position is effected in response to urging by the conveyance member 301.

The wellbore coupler retainer member 310B is also provided and limits uphole displacement of the wellbore coupler 302, relative to the conveyance member 301, while the locator 300 is being run-in-hole with the workstring 220 through the wellbore 102. Referring to FIG. 1A, while being run-in-hole, the wellbore coupler 302 slidably engages the wellbore string 200 in a compressed condition, and is subjected to frictional drag forces exerted by the wellbore string 200, resulting in the wellbore coupler 302 being urged uphole, relative to the mandrel 308, by the frictional drag forces. Co-operatively, the wellbore coupler retainer 310B limits uphole displacement of the wellbore coupler 302, relative to the conveyance member 301, that is being urged by these frictional drag forces, thereby rendering the wellbore coupler 302 translatable with the conveyance member 301 in a downhole direction by virtue of the urging of the displacement of the wellbore coupler 302, in a downhole direction, by the wellbore coupler retainer member 310B. In some embodiments, for example the wellbore coupler retainer member 310B is defined by a shoulder formed in the conveyance member 301.

After the engagement member 306 has become disposed within the locate profile 202, while the engagement member 306 is disposed in the locating position within the locate profile 302, in some embodiments, for example, the displacement of the engagement member 306 from the locating position to the retracted position is along a displacement axis 3024. As described above, the displacement of the engagement member 306 to the retracted position is prevented or impeded by the displacement hindering member 316. In some embodiments, for example, the preventing or impeding of the displacement is effected while the engagement member 306 is supported on, engaged to, or both supported on and engaged to, an engagement surface 3162 of the displacement hindering member 316.

In some embodiments, for example, the normal axis 3164 of the engagement surface 3162 of the displacement hindering member 316 is disposed at an acute angle relative to the displacement axis 3024. In some embodiments, for example, the acute angle is between 10 degrees and 65 degrees. In some embodiments, for example, the acute angle is between 45 degrees and 60 degrees, such as about 53 degrees. In some embodiments, for example, the acute angle is between 15 degrees and 25 degrees, such as about 20 degrees.

In some embodiments, for example, the normal axis of the engagement surface 3162 of the displacement hindering member 316 is disposed at an acute angle relative to a central longitudinal axis 3021 of the conveyance member 301. In some embodiments, for example, the acute angle is between 25 degrees and 80 degrees. In some embodiments, for example, the acute angle is between 30 degrees and 45 degrees, such as about 38 degrees. In some embodiments, for example, the acute angle is between 65 degrees and 80 degrees, such as about 70 degrees.

In some embodiments, for example, the preventing or impeding of the displacement of the engagement member 306 from the locating position to the retracted position, by the displacement hindering member 316, is effected by engagement between an engagement surface 3022 of the wellbore coupler 302 and the engagement surface 3162 of the displacement hindering member 316 (see FIGS. 5A and 5B). In some embodiments, for example, the engagement is a slidable engagement. In this respect, while disposed in the engagement with the displacement hindering member 316, the wellbore coupler 302 is displaceable, relative to the displacement hindering member 316, by slidable movement. In some embodiments, for example, the engagement surface 3162 of the displacement hindering member 316, across which the engagement surface 3022 of the wellbore coupler 302 is configured to slidably traverse, while the displacement of the displacement hindering member 316, relative to the engagement member 306, is being effected for enabling the displacement of the engagement member 306 to the retracted position, has a surface area of at least 0.06 square inches.

In this respect, in another aspect, the engagement member 306 and the displacement hindering member 316 are co-operatively configured such that the engagement member 306 is slidably engaged to the engagement surface 3162 of the displacement hindering member 316, while the displacement of the engagement member 306 to the retracted position is being urged and the displacement hindering member 316 is preventing or impeding the displacement of the engagement member 306 to the retracted position.

In some embodiments, for example, the engagement surface 3022 of the wellbore coupler is disposed on a protuberance 3026. The protuberance 3026 is disposed on a side of the wellbore coupler 302 that is opposite to the side of the wellbore coupler 302 on which the engagement member 306 is disposed. In some embodiments, for example, the protuberance 3026 extends inwardly relative to the central longitudinal axis of the conveyance member 301 (or, towards the central longitudinal axis of the conveyance member 301). In some embodiments, for example, the protuberance 3026 is aligned with the locator block 306A.

While the engagement member 306 is being retained by the locate profile 202, the preventing or impeding of the displacement of the engagement member 306 from the locating position to the retracted position, by the displacement hindering member 316, increases the amount of force that is applied to the engagement member 306 to urge its displacement from the locating position to the retracted position. This provides a less ambiguous indication to an operator at the surface that the engagement member 306 has becomes releasably retained by the locate profile 202.

In some embodiments, for example, the displacement hindering member 316 is displaceable between a wellbore coupler-retaining position (see FIG. 5A) and a non-interference position (see FIGS. 6A and 7), and biased towards the wellbore coupler-retaining position. In the wellbore coupler-retaining position, the displacement hindering member 316 is preventing or impeding displacement of the engagement member 306 to the retracted position. In the non-interference position, opposition, by the displacement hindering member 316, to the displacement of engagement member 306 to the released position, is absent or substantially absent. In some embodiments, for example, the term "substantially absent", in this context, means that, while the engagement member 306 is being displaced from the locating to the retracted position, the magnitude of the force, being applied by the displacement hindering member 316 to the engagement member 306, in a direction that is parallel, or substantially parallel, to an axis along which the engagement member 306 is being displaced from the locating position to the retracted position, is less than 20% (including zero ("0")) of the magnitude of the maximum force being applied by the displacement hindering member 316 to the engagement member 306, in a direction that is parallel, or substantially parallel, to an axis along which the engagement member 306 is being displaced from the locating position to the retracted position, while: (i) the engagement member 306 is disposed in the locating position, (ii) the displacement hindering member 316 is disposed in the wellbore coupler-retaining position, and (iii) displacement of the engagement member 306 towards to the retracted position is being urged.

In some embodiments, for example, the displaceability of the displacement hindering member 316, between the wellbore coupler-retaining position and the non-interference position, is along an axis that is transverse (such as, for example, orthogonal or substantially orthogonal) to the normal axis of the engagement surface 3022.

In some embodiments, for example, the displaceability of the displacement hindering member 316, between the wellbore coupler-retaining position and the non-interference position, is along an axis that is transverse (e.g. orthogonal or substantially orthogonal) to the axis 3024 along which the engagement member 306 is displaceable between the locating and retracted positions.

In some embodiments, for example, the displaceability of the displacement hindering member 316, between the wellbore coupler-retaining position and the non-interference position, is along an axis that is parallel, or substantially parallel, to the central longitudinal axis of the conveyance member 301, or along an axis that is parallel, or substantially parallel, to the central longitudinal axis of the wellbore 102, or both.

In some embodiments, for example, the displaceability of the displacement hindering member 316, from the wellbore coupler-retaining position to the non-interference position, is in a downhole direction.

In one aspect, the engagement member 306 and the displacement hindering member 316 are co-operatively configured such that:

(i) in the wellbore coupler-retaining position, the displacement hindering member 316 prevents or impedes displacement of the engagement member 306 towards the retracted position, while displacement of the engagement member 306 to the retracted position is being urged; and (ii) the engagement member 306 is urging the displacement of the displacement hindering member 316 to the non-interference position (such as, for example, in a downhole direction), for effecting a change in condition of the engagement member 306 such that the engagement member 306 becomes displaceable to the retracted position;

while the displacement of the engagement member 306 to the retracted position is being urged, and the displacement hindering member 316 is preventing or impeding the displacement of the engagement member 306 towards the retracted position.

In this respect, the urging of the displacement of the displacement hindering member 316 to the non-interference position is opposed by the biasing force that biases the displacement hindering member 316 to the wellbore coupler-retaining position. In some embodiments, for example, for effecting the displacement of the displacement hindering member 316 to the non-interference position, the urging of the displacement of the displacement hindering member 316 to the non-interference position overcomes at least the biasing force that biases the displacement hindering member 316 to the wellbore coupler-retaining position.

Also, in this respect, in some embodiments, for example, the displaceability of the displacement hindering member 316 is effectible by slidable mounting of the displacement hindering member 316 over the conveyance member 301. In this respect, the displacement hindering member 316 is displaceable, relative to the conveyance member 301, by slidable movement. In some embodiments, for example, the displacement hindering member 316 is tubular and is slidably mounted over the conveyance member 301, such that the conveyance member 301 extends through the displacement hindering member 316.

In some embodiments, for example, the biasing of the displacement hindering member 316 to the wellbore coupler-retaining position is effected by a biasing member 318, such as a resilient member 318, such as a compression spring 318. Referring to FIGS. 1 to 6, in some embodiments, for example, the biasing member 318 is disposed within a housing 320 that is mounted to the mandrel 301A.

Figures 6A, 6B:
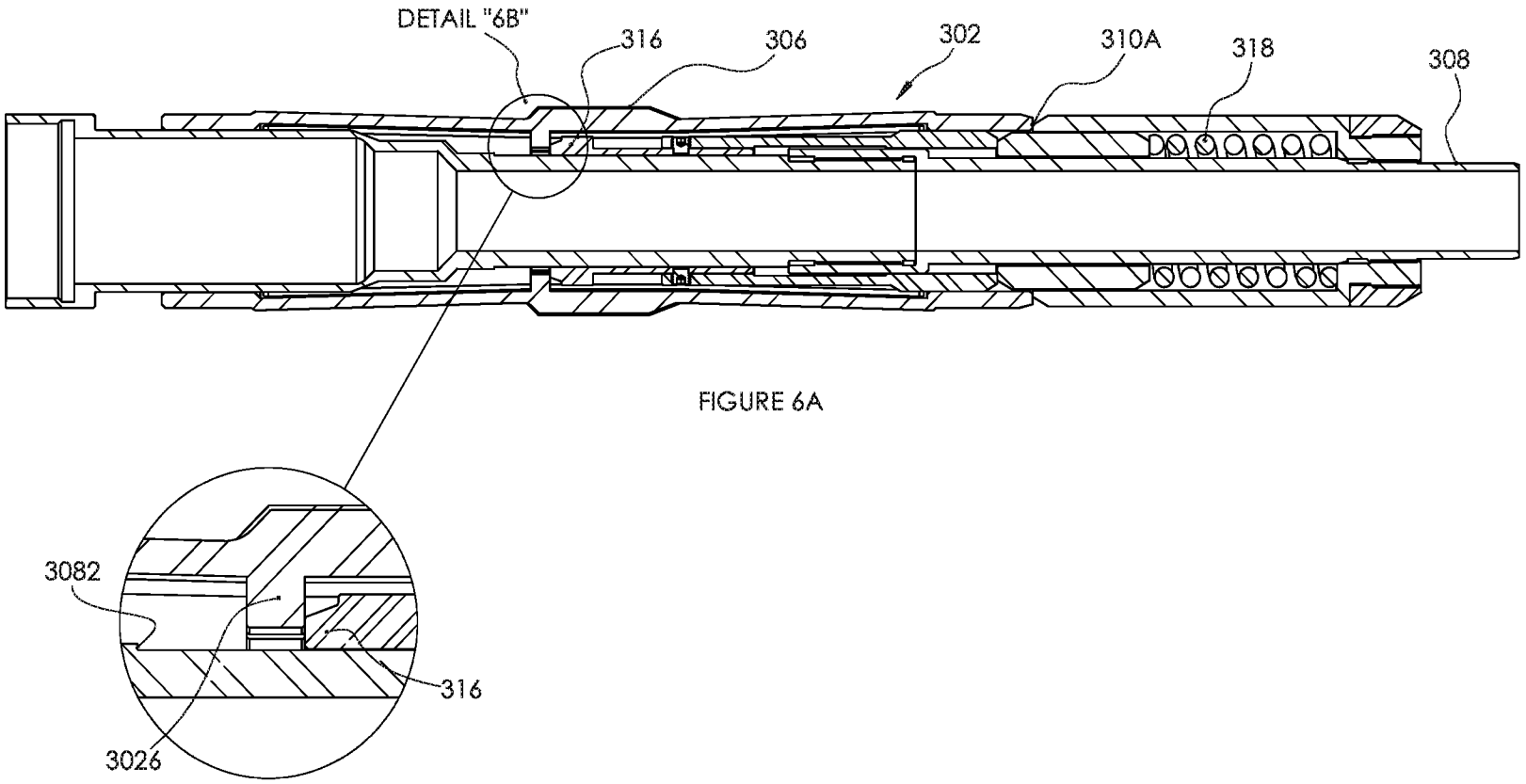
FIG. 6A is a sectional view of the first embodiment of a locator disposed in a condition while being pulled-out-of-hole within a wellbore, and while the engagement member is disposed in the retracted position, after having been released from a locate profile.
FIG. 6B is an enlarged view of Detail "6B" in FIG. 6A.
Figure 7:
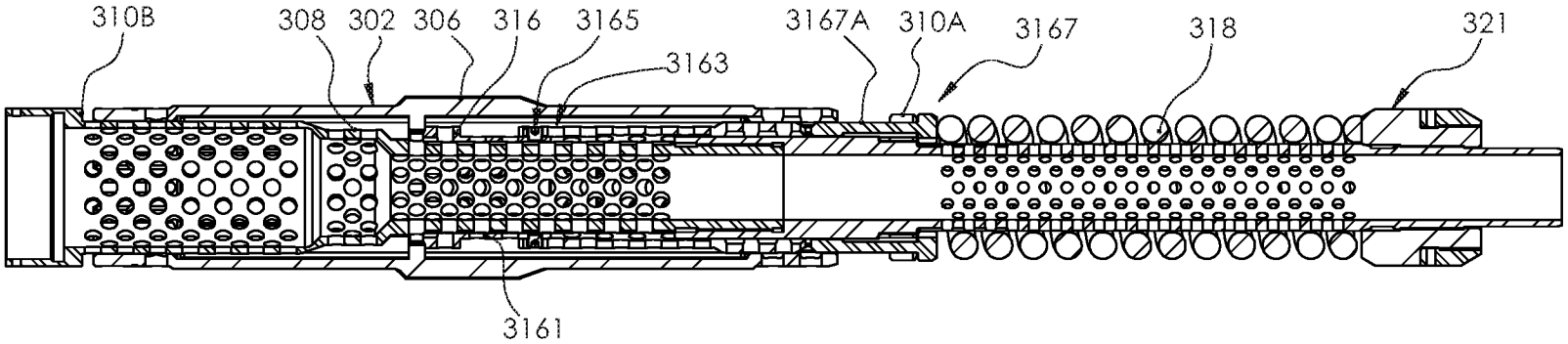
FIG. 7 is a sectional view of a second embodiment of a locator disposed in a condition while being pulled-out-of-hole within a wellbore, and while the wellbore coupler is disposed in a retracted position, after having been released from a locate profile.
Figure 8:
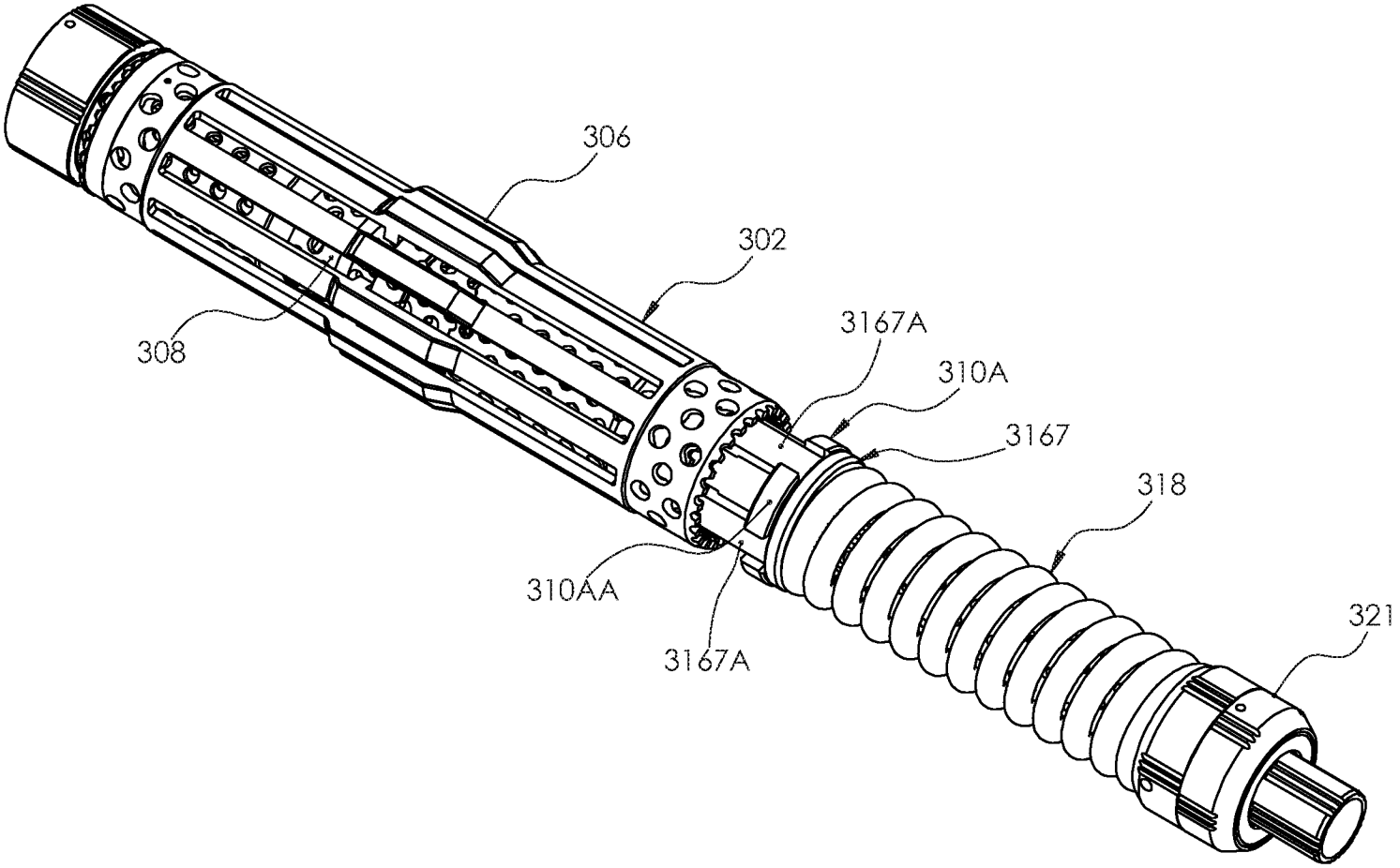
FIG. 8 is a perspective view taken from one end of the second embodiment of a locator.
Figure 9:
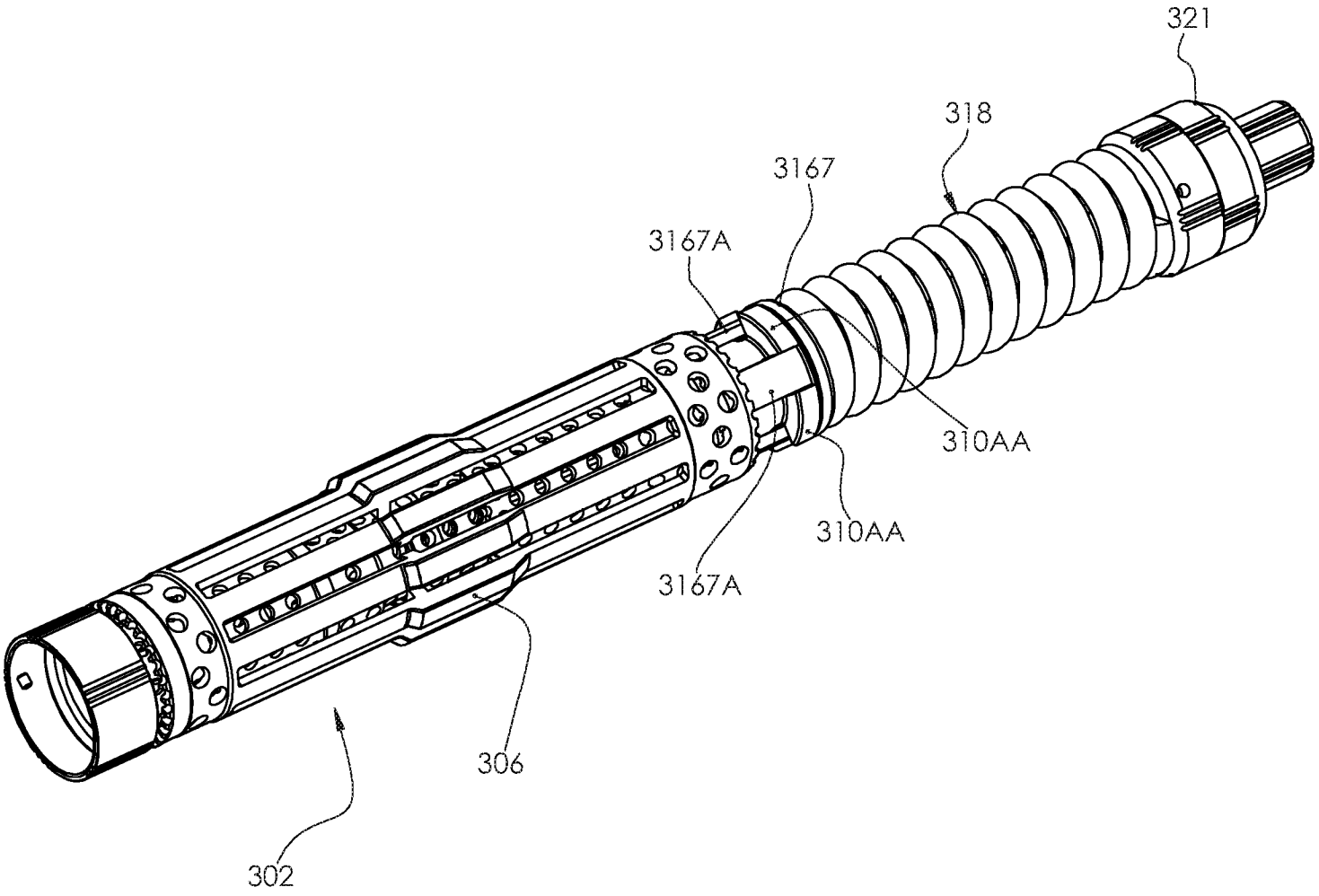
FIG. 9 is a perspective view taken from a second end of the second embodiment of a locator.
Figure 10:
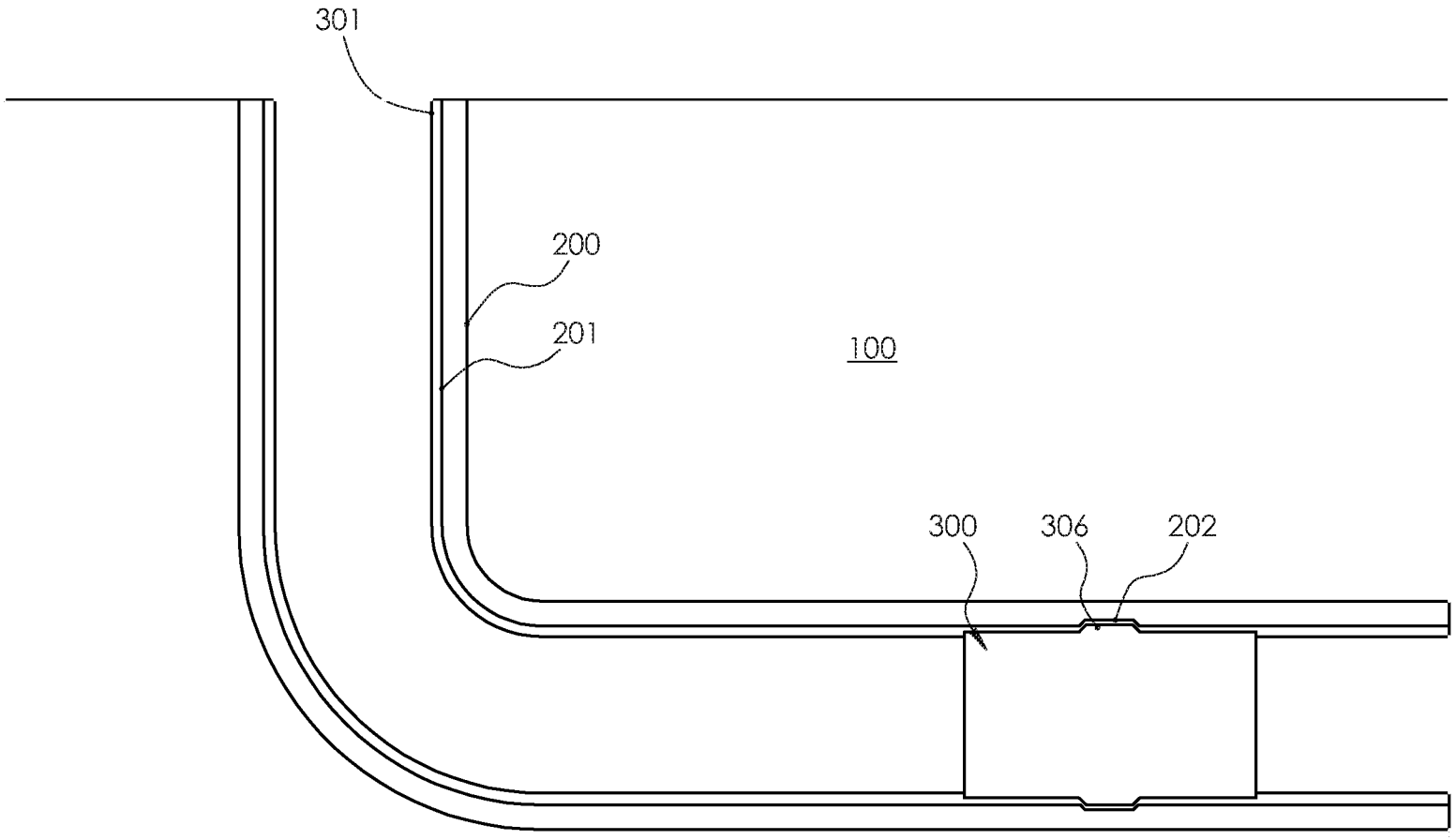
FIG. 10 is a schematic illustration of a workstring deployed within and located within a wellbore using the locator of the present disclosure.

Referring to FIGS. 7 to 9, in some embodiments, for example, the biasing member 318 is in the form of a compression spring characterized by a greater spring force (and, in some embodiments, is characterized by a larger radius) relative to the compression spring illustrated in FIGS. 1 to 6. For example, the compression spring in FIGS. 7 to 9 is characterized by a spring force of between 2,000 to 2,500 pounds, whereas the compression spring in FIGS. 1 to 6 is characterized by a spring force of about 500 pounds. A compression spring, with a larger spring force, may be suitable in those embodiments where the normal axis 3164 of the engagement surface 3162 of the displacement hindering member 316 is disposed at relatively greater angles of inclination relative to the displacement axis 3024.

In response to the urging of the displacement of the displacement hindering member 316 to the non-interference position by the engagement member 306, while the displacement of the engagement member 306 to the retracted position is being urged and the displacement hindering member 316 is preventing or impeding the displacement of the engagement member 306 towards the retracted position, the displacement hindering member is displaced towards the non-interference position with effect that the resilient member 118 absorbs energy and becomes compressed. Upon the conveyance member 301 becoming pulled uphole such that the engagement member 306 becomes aligned with another locate profile 202 such that the engagement member 306 becomes displaced to the locating position and disposed within the locate profile 202, the absorbed energy becomes released, the resilient member 118 becomes extended, and the displacement hindering member 316 becomes displaced towards the wellbore coupler-retaining position.

In some embodiments, for example, the displacement hindering member 316 includes a wellbore coupler-engagement portion 3161 that includes the engagement surface 3162, and also includes a shearable portion 3163 interposed between the wellbore coupler engagement portion 3161 and the biasing member 318, and coupled to the portion 3161 with a shear pin 3165. In some instances of operation, the compressibility of the resilient member 318 may become compromised due to solids ingress, preventing, or impeding, displacement of the displacement hindering member 316 for enabling releasing of the engagement member 306 from retention by the locate profile 202. In such cases, to mitigate damage to the locator 300, upon application of a sufficient force to the wellbore coupler-engagement portion 3161, the shear pin 3165 is configured to fracture to enable independent movement of the portion 3161 relative to the portion 3163.

In some embodiments, for example, the displacement hindering member 316 further includes a force transmission member 314 including a pusher 3167 (such as a piston 3167) that is coupled to the biasing member 318, and interposed between the shearable portion 3163 and the biasing member 318, while being in contact engagement with the portion 3163. In some embodiments, for example, the piston 3167 is absent. In some embodiments, for example, having a separate piston 3167 provides flexibility in re-configuring the locator to incorporate a different mechanism for promoting reliable locating.

In those embodiments where the biasing member 318 is in the form of a larger compression spring, the housing 320 is not provided, (such as, for example, the embodiment illustrated in FIGS. 7 to 9). In some of these embodiments, for example, the biasing member 318 is retained between a resilient member retainer 321 and the collar 310A. In such embodiments, for example, the collar 310A includes a plurality of spaced-apart tabs 310AA each one of the tabs 310AA extending outwardly (e.g. radially) relative to a central longitudinal axis of the mandrel. The piston 3167 includes a base 3167A and a plurality of fingers 3167B extending longitudinally from the base 3167A and through the spaces between the tabs 310AA. The base 3167A is coupled to the resilient member 318. The fingers 3167B are for effecting contact engagement with the shearable portion 3163 of the displacement hindering member 3161, and thereby effecting force transmission between the shearable portion 3163 and the biasing member 318. The piston 3167 is movable relative to the collar 310A to facilitate displacement of the displacement hindering member 316 from the wellbore coupler-retaining position to the non-interference position, such as that being urged by the engagement member 306 while an uphole pulling force is being applied to the wellbore coupler 302 via the collar 310A. In so doing, the fingers 3167B move through the spaces between the tabs 310AA. The collar 310A also functions as a retainer for opposing displacement of the piston 3167 in a direction opposite to the direction in which the displacement hindering member 316 is displaced while being displaced from the wellbore coupler-retaining position to the non-interference position.

Referring to FIG. 1A, while the locator 300 is being run-in-hole into the wellbore 102, the displacement hindering member 316 is maintained spaced-apart from the engagement member 306 such that the displacement hindering member 316 does not interfere with displacement of the engagement member 306 between the locating and the retracted positions. In some embodiments, during the running-in-hole of the locator 300 into the wellbore 102, the engagement member 306 traverses one or more locate profiles 302 within the wellbore 102, and it is desirable to provide conditions such that the force required to conduct the locator 300 (and, therefore, the engagement member 306) past the locate profiles 302 is minimized. With a view to minimizing such force, the displacement hindering member 316 and the engagement member 306 are co-operatively configured such that, while the locator 300 is being run-in-hole into the wellbore 102, the displacement hindering member 316 is disposed relative to the engagement member 306 such that interference, by the displacement hindering member 316, to the displacement of the engagement member 306 between the locating and retracted positions is absent or substantially absent. In some embodiments, for example, while the locator 300 is being run-in-hole into the wellbore 102, the displacement hindering member 316 is spaced apart relative to the engagement member 306 In this respect, in some embodiments, for example, the conveyance member 301 includes a displacement hindering member retainer 3082 for limiting uphole displacement of the displacement hindering member 316 relative to the conveyance member 301 (which, in some embodiments, is being urged by frictional drag forces exerted by the wellbore string) such that while the locator 300 is being run-in-hole into the wellbore 102, the displacement hindering member 316 is disposed relative to the engagement member 306 such that interference, by the displacement hindering member 316, to the displacement of the engagement member 306 between the locating and the retracted positions, is absent or substantially absent (and, in some embodiments, for example, the engagement member 306 is maintained in a spaced apart relationship relative to the displacement hindering member 316).

In some embodiments, for example, the locating of the locator 300 is effected while the locator is being pulled-out-of-hole. In this respect, in some embodiments, for example, after the running-in-hole of the locator 300, the locator 300 is conducted uphole in response to displacement of the conveyance member 301 in the uphole direction. In the illustrated embodiments, the pulling up force applied to the conveyance member 301 via the workstring 220 is transmitted to the wellbore coupler 302 via a force transmission surface 3167 of the displacement hindering member 316 (see FIG. 2B). In some embodiments, for example, the normal axis of the force transmission surface 3167 is disposed parallel, or substantially parallel, to a central longitudinal axis of the conveyance member 301. In this respect, after the locator 300 has been run-in-hole to a desired location within the wellbore 102 (for example, estimated based on the length of workstring 220 that has been deployed downhole), a pulling up force is exerted on the workstring 220, causing the conveyance member 301 to be pulled up hole. The pulling up force is transmitted to the displacement hindering member 316 via the resilient member 318, and consequently to the wellbore coupler 302 (more specifically, the protuberance 3026), resulting in uphole displacement of the engagement member 306. In the illustrated embodiment, in this configuration, the engagement member 306 is spaced apart from the collar 310A of the mandrel 308.

A locating operation using embodiments of the locator 300 illustrated in FIGS. 1 to 10, will now be described.

Referring to FIGS. 1 to 10, the locator 300 is run-in-hole with the workstring 220. While the locator 300 is being run-in-hole into the wellbore 102, the wellbore coupler 302 slidably engages the wellbore string 200 in a compressed condition, and is subjected to frictional drag forces exerted by the wellbore string 200, resulting in the wellbore coupler 302 being urged uphole, relative to the mandrel 308, by the frictional drag forces. Co-operatively, the wellbore coupler retainer 310B limits uphole displacement of the wellbore coupler 302, relative to the conveyance member 301, that is being urged by these frictional drag forces, thereby rendering the wellbore coupler 302 translatable with the conveyance member 301 in a downhole direction by virtue of the urging of the displacement of the wellbore coupler 302, in a downhole direction, by the wellbore coupler retainer member 310B. In parallel, the engagement member 306 is maintained in a spaced apart relationship relative to the displacement hindering member 316 by the displacement hindering member retainer 3082.

Figure 3A:
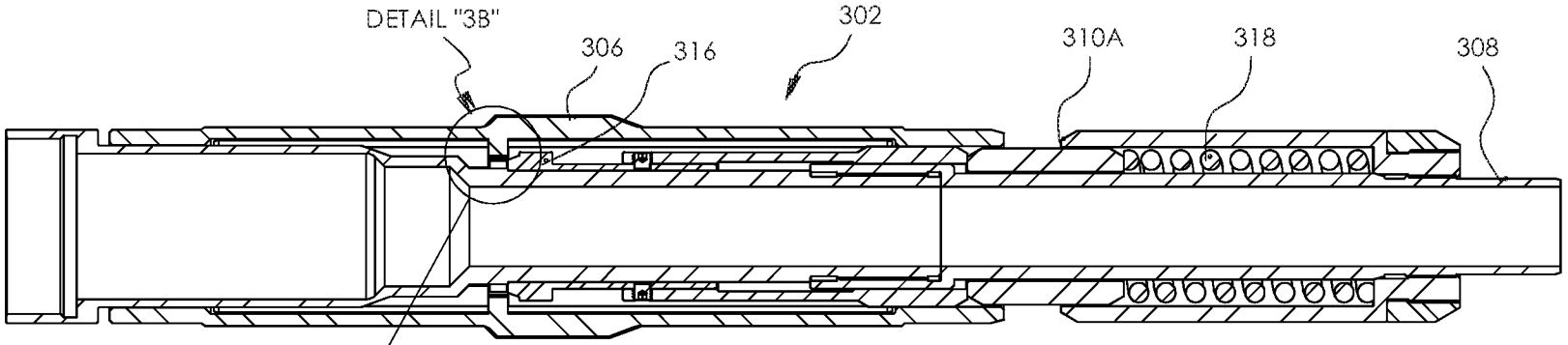
FIG. 3A is a sectional view of the first embodiment of a locator disposed in a condition while being pulled-out-of-hole within a wellbore, while the engagement member of the wellbore coupler is disposed in the locating position, but without a force being applied by the mandrel urging displacement of the engagement member of the wellbore coupler to the retracted position; and without the engagement surface of the displacement hindering member having become oriented to oppose displacement of the wellbore coupler to the released position.
Figure 3B:
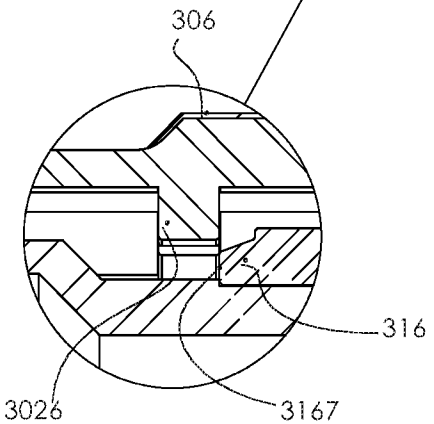
FIG. 3B is an enlarged view of Detail "3B" in FIG. 3A.
Figure 4A:
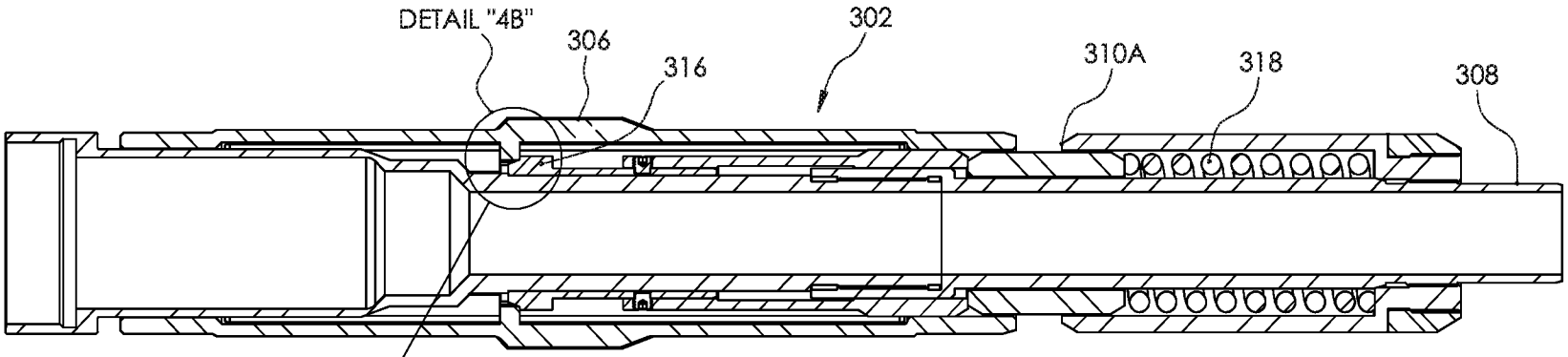
FIG. 4A is a sectional view of the first embodiment of a locator disposed in a condition while being pulled-out-of-hole within a wellbore, while the engagement member of the wellbore coupler is disposed in the locating position and the engagement surface of the displacement resistor is oriented to prevent displacement of the engagement member to the retracted position, but without a force being applied by the mandrel urging displacement of the wellbore coupler to the retracted position.
Figure 4B:
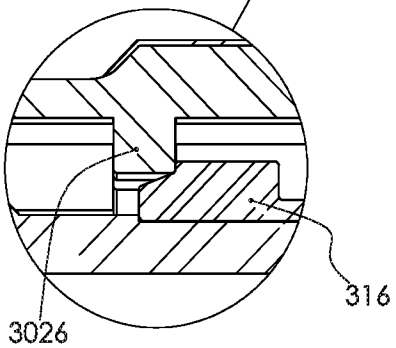
FIG. 4B is an enlarged view of Detail "4B" in FIG. 4A.

Upon moving past the general area where locating is intended, the workstring 220 reverses direction and is then pulled uphole, along with the conveyance member 301. By virtue of its engagement with the pusher 3167, the displacement hindering member 316, likewise, is pulled uphole. Similarly, by virtue of its engagement with the displacement hindering member 316, the wellbore coupler 302 (including the engagement member 306) is also pulled uphole. Referring to FIG. 3A, while the locator 300 is being pulled uphole, upon alignment of the engagement member 306 with the locate profile 202, the collet springs 304 expand such that the engagement member 306 becomes disposed within the locate profile 202. In this configuration, the engagement member 306 is disposed in the locating position.

Upon the engagement member 306 becoming disposed within the locate profile 202, further application of a pulling force to the workstring 300 results in displacement of the conveyance member 301 relative to the engagement member 306 (such as, for example, in an uphole direction) until the wellbore coupler 302 shoulders on the collar 310A (see FIG. 5A). Either before (see FIG. 4A) or at the time the wellbore coupler 302 shoulders on the collar 310A, the engagement surface 3162 of the displacement hindering member 316 becomes disposed in engagement with the engagement surface 3022 of the wellbore coupler 302. In those embodiments where the engagement surface 3162 of the displacement hindering member 316 becomes disposed in engagement with the engagement surface 3022 of the wellbore coupler 302 prior to the shouldering of the wellbore coupler 302 on the collar 310A (see FIGS. 4A and 4B), because the displacement hindering member 310 is disposed in engagement with the wellbore coupler 302 (more specifically, the protuberance 3026), as further uphole pulling force is applied, the resilient member 318 becomes compressed.

Upon the shouldering of the wellbore coupler 302 on the collar 310 (see FIG. 5A), application of an uphole pulling force on the workstring 220 results in transmission of the uphole pulling force to the wellbore coupler 302. If the transmitted force is sufficient, the protuberance 3026 is caused to slide downwardly (towards the central longitudinal axis of the conveyance member 301) against the engagement surface 3162 of the displacement hindering member 316. In parallel, contraction of the engagement member 306 is effected. In order to effect the contraction of the wellbore coupler, the transmitted force is sufficient to overcome at least the combination of: (i) the force resisting relative movement between the wellbore coupler 302 (i.e. locator block 306A) and the locate profile 202, (ii) the spring force of the wellbore coupler 302, (iii) the force resisting relative movement between the engagement member 306 and the displacement hindering member 316, and (iv) the force being applied by the resilient member 31.

Eventually, the protuberance 3026 loses contact with the engagement surface 3162, resulting in a stepwise reduction in force for effecting the displacement of the engagement member 306 from the locating position to the retracted position (i.e. the release of the engagement member 306 from retention within the locate profile 202), such that a relatively weak pulling up force is required to effect the displacement of the engagement member 306 to the retracted position (see FIGS. 6A and 6B). In the illustrated embodiment, this stepwise reduction is attributable to the fact that, instead of being required to overcome the frictional force opposing the movement of the engagement surface 3022 of the protuberance 3026 relative to the engagement surface 3162 of the displacement hindering member 316, the normal axis of which is disposed at an angle relative to axis of displacement along which the protuberance 3026 is being displaced towards the retracted position, the uphole pulling force is required to only overcome the frictional force opposing the movement of the engagement surface 3022 of the protuberance 3026 relative to a surface 3168 of the displacement hindering member 316 that is disposed parallel to, or substantially parallel to, the axis of displacement along which the protuberance 3026 is being displaced towards the released position, which is of a much smaller magnitude.

Once the engagement member 306 has become disposed in the retracted position, the locator may be conducted uphole to effect locating with the next uphole locate profile 202, by pulling up on the workstring 220. As the workstring is pulled uphole, the first pusher 330, by virtue of its engagement to the displacement hindering member 316, urges the displacement of the displacement hindering member 316 in concert with the workstring 316. In parallel, by virtue of the engagement of the engagement member 306 to the displacement hindering member 316, the wellbore coupler 302 is also pulled uphole. Upon alignment with the next profile, the engagement member 306 becomes displaced, being urged by the bias of the collet springs 304.

Referring to the embodiments illustrated in FIGS. 11 to 20, in some embodiments, for example, the impeding of the displacement of the displacement hindering member 316, relative to the engagement member 306, by fluid flow resistance, and thereby delaying the release of the engagement member 306 from retention by the locate profile, by opposition to fluid flow urged by such displacement, is effected. The impeding of the displacement provides more time for an operator at the surface to observe an indication that the engagement member 306 has become releasably retained by the locate profile 202 (e.g. an increase in force required to displace the engagement member 306 from the locate profile 202).

In this respect, in some embodiments, for example, the locator further includes fluid 332, and the fluid 332 is disposed within the fluid conductor 334 for being displaced through the fluid conductor 334 by a reaction force that is responsive to a displacement-urging force that is urging the displacement of the displacement hindering member 316, relative to the engagement member 306, while the displacement of the engagement member 306 to the retracted position is being prevented or impeded, for effecting the change in condition of the engagement member 306 such that the engagement member 306 becomes displaceable (for example, relative to the locate profile 202) to the retracted position.

The displacement of the fluid 332 includes conduction of the fluid 332 through the fluid conductor 334 for effecting the impeding of the displacement of the displacement hindering member 316 relative to the engagement member 306 while such displacement is being urged. In some embodiments, for example, the impeding of the displacement is attributable to resistance to fluid flow that is imparted by the fluid conductor 334 while the fluid 332 is being conducted through the fluid conductor 334.

In some embodiments, for example, the fluid conductor 334 includes a flow restrictor 336.

In some embodiments, for example, the fluid conductor 334 includes a valve member 338 disposed in fluid communication with the fluid 332 and configured for opening in response to pressure of the fluid 332 exceeding a predetermined minimum pressure, wherein the fluid 332 is disposed in force transmission communication with the engagement member 306 such that the force urging the displacement of the displacement hindering member 316 relative to the engagement member 306 (for effecting the change in condition of the engagement member 306, such as, for example, the unseating of the protuberance 3026) is transmitted to the fluid 332 to effect an increase in pressure of the fluid 332, wherein the exceeding of a predetermined minimum pressure corresponds to the application of a force that is at or above the predetermined minimum force. In this respect, the valve member 338 functions as a pressure relief device.

In some embodiments, for example, the engagement member 306, the fluid conductor 334, the fluid 332 and the displacement hindering member 316 are co-operatively configured such that:

(i) displacement of the displacement hindering member 316 relative to the engagement member 306 is effected for effecting the change in condition of the engagement member 306 such that the engagement member 306 becomes displaceable (for example, relative to the locate profile 202) to the retracted position;

(ii) displacement of the fluid through the fluid conductor 334 is effected by the reaction force, with effect that the displacement of the displacement hindering member 316 relative to the engagement member 306 is impeded;

in response to: (a) application of a displacement-urging force (e.g. uphole pulling force on the workstring 220), that is urging the displacement of the displacement hindering member 316 relative to the engagement member 306 for effecting the change in condition of the engagement member 306 such that the engagement member 306 becomes displaceable (for example, relative to the locate profile 202) to the retracted position, and (b) application of a reaction force to the fluid 332, wherein the reaction force is responsive to the displacement-urging force, wherein both of (a) and (b) are effected while the displacement hindering member 316 is preventing, or impeding, displacement of the engagement member 306 to the retracted position.

In some embodiments, for example, after the engagement member 306 has become disposed in the retracted position (see FIGS. 20A-D), in some of these embodiments, for example, the workstring 220 is pulled uphole so as to effect locating within another region of the wellbore 102, further uphole from the earlier locate. In order for the engagement member 306 to become releasably retained by an uphole locate profile 202, while introducing a delay to its release from such releasable retention from the locate profile 202, the engagement member 306 is displaceable relative to the displacement hindering member 316, while the engagement member 306 is displaceable between the locating and retracted positions, by a return device 340, with effect that the engagement member and the displacement hindering member become co-operatively disposed such that the displacement of the engagement member to the retracted position is prevented or impeded.

In this respect, in some embodiments, for example, the functionality of re-seating the engagement member 306 on the displacement hindering member 316, for preventing, or impeding, the release of the engagement member 306 from retention by another locate profile 202, is combined with the functionality of impeding the displacement of the displacement hindering member 316, relative to the engagement member 306, for effecting the change in condition of the engagement member 316 (such that the engagement member becomes displaceable to the retracted position), so that there is sufficient time for a positive indication of the locating of the wellbore coupler 302, effected by the preventing, or impeding, to be detected uphole.

In this respect, in some embodiments, for example, the locator 300 includes a force transmitter 314. The force transmitter 314 urges translation of the wellbore coupler 302 with the conveyance member 301, during uphole displacement of the conveyance member 301 through the wellbore 102. In some embodiments, for example, the force transmitter 314 also urges displacement of the wellbore coupler 302, relative to the displacement hindering member 316, for effecting seating (including re-seating) of the engagement member 306 on the displacement hindering member 316. In this respect, the force transmitter 314 includes a first pusher 330, a second pusher 342, and the fluid 332. In some embodiments, for example, the force transmitter 314 is disposed within a housing 344 that is mounted to the conveyance member 301.

The force transmitter 314 is biased by a biasing member 341 for urging, via the force transmitter 314, the displacement of the engagement member 306 relative to the displacement hindering member 316 (such as, for example, in the uphole direction, and, in some embodiments, along an axis that is parallel to the central longitudinal axis of the conveyance member 301, or along an axis that is parallel to the central longitudinal axis of the wellbore, or both), while the engagement member 306 is displaceable between the locating and retracted positions (i.e. the displacement hindering member and the engagement member are co-operatively disposed such that there is an absence, or substantial absence, of the preventing, or impeding, of the displacement of the engagement member 306 to the retracted position), with effect that the engagement member 306 and the displacement hindering member 316 become co-operatively disposed such that the displacement of the engagement member 306 to the retracted position is prevented or impeded.

In some embodiments, for example, the biasing member 341 is retained by a biasing member retainer 348 defined within the housing 344.

In some embodiments, for example, the biasing member 341 is resilient. In some embodiments, for example, the biasing member includes a spring.

The reaction force overcomes at least the biasing force of the biasing member 341.

The fluid conductor 334 includes a first compartment 346 and a second compartment 350, and also includes one or more displacement-impeding fluid passages and a return fluid passage 352.

One or more displacement-impeding fluid passages are provided for conducting the fluid 332 while the fluid 332 is being displaced from the second compartment 350 to the first compartment 346.

In some embodiments, for example, the one or more displacement-impeding fluid passages includes a first displacement-impeding fluid passage 354. The first displacement-impeding fluid passage 354 includes a valve member 338 configured for opening in response to pressure of the fluid 332 exceeding a predetermined minimum pressure, wherein the fluid 332 is disposed in force transmission communication with the engagement member 306 such that the force urging the displacement of the displacement hindering member 316 relative to the engagement member 306 (for effecting the change in condition of the engagement member 306 such that the engagement member 306 becomes displaceable to the retracted position.) is transmitted to the fluid 332 to effect an increase in pressure of the fluid 332, wherein the exceeding of a predetermined minimum pressure corresponds to the application of a force that is at or above the predetermined minimum force.

In some embodiments, for example, the one or more displacement-impeding fluid passages includes a second displacement-impeding fluid passage 356. In some embodiments, for example, the second displacement-impeding fluid passage 356 also includes a flow restrictor 336, such as, for example, an orifice.

The second displacement-impeding fluid passage 356 is configured for conducting the fluid 332 while the fluid 332 is being displaced from the second compartment 350 to the first compartment 346, and also while the fluid 332 is being displaced from the second compartment 350 to the first compartment 346. The second displacement-impeding fluid passage 356 is co-operatively configured with a return fluid passage 352, for effecting the impeding of the displacement of the displacement hindering member 316 relative to the engagement member 306 during the effecting of a change in condition of the engagement member 306 such that the engagement member 306 becomes displaceable to the retracted position.

In some embodiments, for example, the second displacement-impeding fluid passage 356 is additional to the first displacement-impeding fluid passage 354. In some embodiments, for example, the locator 300 includes only one of the first and second displacement-impeding fluid passages 354, 356. In those embodiments where the locator includes both of the fluid passages 354, 356, for example, the first displacement-impeding fluid passage 354 is provided, to complement the second displacement-impeding fluid passage 356, by providing a means for more rapidly depressurizing the first compartment 332 when the force being applied by the first pusher to the wellbore coupler 302, for urging retraction of the engagement member 306 from the locate profile 202, is excessive, and may result in premature retraction even while the displacement is being prevented, or impeded, by the displacement hindering member 316, unless the fluid within the first compartment 332 is bled to the second compartment 350 at a faster rate than permitted via the second displacement-impeding fluid passage 356. The second displacement-impeding fluid passage 356 is independently useful in those cases where the pulling up force is relatively weak (such as when locating at relatively significant distances from the surface) and would not be sufficient to trigger opening of the valve member 338 within the first displacement-impeding fluid passage 354.

The return fluid passage 352 is provided for conducting the fluid 332 while the fluid 332 is being displaced from the first compartment 346 to the second compartment 350. The return fluid passage includes a one-way valve 358 for preventing, or substantially preventing, conduction of the fluid 332 from the second compartment 350 to the first compartment 346 via the return fluid passage 352. By providing the one-way valve 358, the return fluid passage 352 is not functional for conducting fluid being displaced from the second compartment 350 to the first compartment 346, which would otherwise detract from the impeding of such fluid conduction that is imparted by the one or more displacement-impeding fluid passages while the displacement of the engagement member 306, relative to the displacement hindering member 316, is being effected to effect the change in condition of the engagement member 306 such that the engagement member 306 becomes displaceable to the retracted position.

In those embodiments where the second displacement-impeding fluid passage 356 is provided, in some of these embodiments, for example, the resistance to fluid flow, that the second displacement-impeding fluid passage 356 is configured to provide while conducting the fluid from the first compartment 346 to the second compartment 350, is greater than the resistance to fluid flow, that the return fluid passage 352 is configured to provide while conducting the fluid from the first compartment 346 to the second compartment 350, such as, for example, by a multiple of at least 1.1, such as, for example, by a multiple of at least 2. In some embodiments, for example, the minimum cross-sectional flow area of the return fluid passage 352 is greater than the minimum cross-sectional flow area of the second displacement-impeding passage 356, such as, for example, by a multiple of at least 1.1, such as, for example, by a multiple of at least 2. The resistance to fluid flow that the return fluid passage 352 is to provide is, in some embodiments, for example, less than that of the second displacement-impeding fluid passage 356. Otherwise, the rate at which fluid is being conducted from the second compartment 350 to the first compartment 346 may be insufficient in some embodiments for reliably effecting displacement of the engagement member 306, relative to the displacement hindering member 316, for effecting the co-operative disposition of the engagement member 306 and the displacement hindering member 316 such that the displacement of the engagement member to the retracted position is prevented or impeded.

The fluid 332 is disposed within the fluid conductor 334 and configured for:

(i) being displaced from the first compartment 346 to the second compartment 350 by a reaction force that is responsive to a displacement force that is urging the displacement of the displacement hindering member 316 relative to the engagement member 306, while the displacement of the engagement member to the retracted position is being prevented or impeded, for effecting the change in condition of the engagement member 306 such that the engagement member 306 becomes displaceable to the retracted position, and;

(ii) being displaced from the second compartment 350 to the first compartment 346 in response to the urging of the biasing member 341.

The first pusher 330 is provided for transmitting a displacement-urging force (e.g. the force being applied to the workstring while the workstring is being pulled uphole) being received by the conveyance member for urging displacement of the locator 300 (e.g. uphole through the wellbore 102, and, in some embodiments, along an axis that is parallel to the central longitudinal axis of the conveyance member 301, or along an axis that is parallel to the central longitudinal axis of the wellbore, or both).

The first pusher 330 is also provided for urging conduction of the fluid 332 through the fluid conductor 334 in response to the relative displacement, between the engagement member 306 and the displacement hindering member 316 (for effecting the change in condition of the engagement member 306 such that the engagement member 306 becomes displaceable to the retracted position), for effecting impeding of such relative displacement.

The first pusher 330 is also provided for transmitting a biasing force received from the biasing member 341, via at least the second pusher 342 and the fluid 332 for effecting co-operative disposition of the displacement hindering member 316 relative to the engagement member 306 such that displacement of the engagement member 306 to the retracted position is prevented or impeded.

The second pusher 342 is coupled (e.g. connected) to the biasing member 341 such that the biasing of the force transmitter 314 by the biasing member 341 is effected by the coupling of the second pusher 342 to the biasing member 341. In this respect, the second pusher 342 is disposed for effecting force transmission communication between the biasing member 341 and the fluid 332.

The fluid 332 is disposed, relative to the first and second pushers 330, 342 for effecting force transmission communication between the first and second pushers 330, 342. In some embodiments, for example, the fluid is disposed between the first and second pushers 330, 342, and, in this respect, the second pusher 342 is disposed between the fluid 332 and the biasing member 341.

The engagement member 306, the displacement hindering member 316, the force transmitter 314, the biasing member 341, and the fluid conductor 334 are co-operatively configured such that:

the first pusher 330 urges displacement of the fluid 332 within the fluid conductor 334 with effect that: (i) the relative displacement, between the engagement member 306 and the displacement hindering member 316, for effecting the change in condition of the engagement member 306 such that the engagement member 306 becomes displaceable to the retracted position, is impeded, and (ii) absorption of energy by the biasing member 341 is effected;

in response to the relative displacement, between the engagement member 306 and the displacement hindering member 316, for effecting the change in condition of the engagement member 306 such that the engagement member 306 becomes displaceable to the retracted position.

In some of these embodiments, for example, the engagement member 306, the first pusher 330, the first compartment 346, the fluid 332, the second compartment 350, the second pusher 342, the first and second displacement-impeding fluid passages 354, 356, the return fluid passage 352, and the biasing member 341 are co-operatively configured such that:

the first pusher 330 is displaced within the first compartment 346 (for example, in a downhole direction) with effect that the volume of the space within the first compartment 346, that is available for occupation by the fluid 332, decreases;

the first pusher 330 urges displacement of the fluid 332 from the second compartment 350 to the first compartment 346 (via at least one of the first and second displacement-impeding fluid passages 354, 356) with effect that the relative displacement, between the engagement member 306 and the displacement hindering member 316, for effecting a change in condition of the engagement member 306 such that the engagement member 306 becomes displaceable to the retracted position, is impeded;

the second pusher 342 is displaced within the second compartment 350, with effect that the volume of the space within the second compartment 350, that is available for occupation by the fluid 332, increases;

compression of the biasing member 341 is being effected such that absorption of energy by the biasing member 341 is effected;

while: (i) the engagement member 306 is disposed within the locate profile 202 and prevented, or impeded, from being displaced to the retracted position by the displacement hindering member 316; (ii) the biasing member is extended from the compressed position (for example, the biasing member is disposed in the extended position); (iii) the displacement-urging force is being received by the displacement hindering member 316 (for example, the displacement-urging force is being transmitted from the workstring 220 to the displacement hindering member 316) such that the first pusher is applying the pusher force to the wellbore coupler 302; and (iv) the pusher force is being opposed (such as, for example, by the releasable retention of the engagement member 306 within the locate profile 202) with effect that a reaction force is applied to the first pusher 330.

The engagement member 306, the displacement hindering member 316, the force transmitter 314, and the biasing member 341 are also co-operatively configured such that:

displacement of the displacement hindering member 316 relative to the engagement member 306 is effected for effecting co-operative disposition of the displacement hindering member 316 relative to the engagement member 306 such that displacement of the engagement member 306 to the retracted position is prevented or impeded;

in response to the urging by the biasing member 341, via the force transmitter, while: (i) the engagement member 306 is engaged to the first pusher 330, (ii) the engagement member 306 is displaceable between the locating and retracted positions; and (iii) the biasing member 341 is disposed for releasing energy for effecting the urging.

In some of these embodiments, for example, the effected displacement of the displacement hindering member 316 relative to the engagement member 306 is effected for effecting co-operative disposition of the displacement hindering member 316 relative to the engagement member 306 such that displacement of the engagement member 306 to the retracted position is prevented or impeded, is a displacement in an uphole direction. In some embodiments, for example, the effected displacement is a along an axis that is parallel to the central longitudinal axis 301B of the conveyance member 301. In some embodiments, for example, the effected displacement is a displacement is a displacement along an axis that is transverse to the axis along which the engagement member 306 is displaceable between the locating and retracted positions.

In some of these embodiments, for example, the wellbore coupler 302, the first pusher 330, the first compartment 346, the fluid 332, the second compartment 350, the second pusher 342, the one or more displacement-impeding fluid passages 354, 356, the return fluid passage 352, and the biasing member 341 are also co-operatively configured such that:

extension of the biasing member is effected;

the second pusher 342 is displaced within the second compartment 350, with effect that the volume of the space within the second compartment 350, that is available for occupation by the fluid 332, decreases;

the fluid 332 is displaced from the second compartment 350 to the first compartment 346 via at least the return fluid passage 352;

the first pusher 330 is displaced within the first compartment 346, with effect that the volume of the space within the first compartment 346, that is available for occupation by the fluid 332, increases;

the engagement member 306 is displaced, relative to the displacement hindering member 316, for effecting co-operative disposition of the displacement hindering member 316 relative to the engagement member 306 such that displacement of the engagement member 306 to the retracted position is prevented or impeded;

in response to urging by the biasing member, while: (i) the engagement member 306 is engaged to the first pusher 330, (ii) the engagement member 306 is displaceable between the locating and retracted positions; and (iii) the biasing member 341 is disposed for releasing energy for effecting the urging.

The embodiments illustrated in FIGS. 11 to 16 are similar to those illustrated in FIGS. 1 to 10. Like the embodiments illustrated in FIGS. 1 to 10, the embodiments of the locator illustrated FIGS. 11 to 16 are configured for effecting the impeding of the displacement of the displacement hindering member 316, relative to the engagement member 306. However, unlike the embodiments illustrated in FIGS. 1 to 10, the impeding of the displacement of the displacement hindering member 316, relative to the engagement member 306, in the embodiments of the locator illustrated in FIGS. 11 to 16, is additionally effected by fluid flow resistance, as described above.

Specifically, with respect to the embodiments of the locator illustrated in FIGS. 11 to 16, and as described above, the force transmitter 314 of the locator 300 includes the first pusher 330, the second pusher 342, and the fluid 332. In some embodiments, for example, the force transmitter 314 is disposed within a housing 344 that is mounted to the conveyance member 301. The fluid conductor 334 is also provided for conducting the fluid 332 being displaced. The fluid conductor 334 includes the first compartment 346 and the second compartment 350, and also includes the first displacement-impeding fluid passage 354 and the return fluid passage 352. In some embodiments, for example, the fluid conductor 334 also includes the second displacement-impeding fluid passage 356.

Figure 11A:
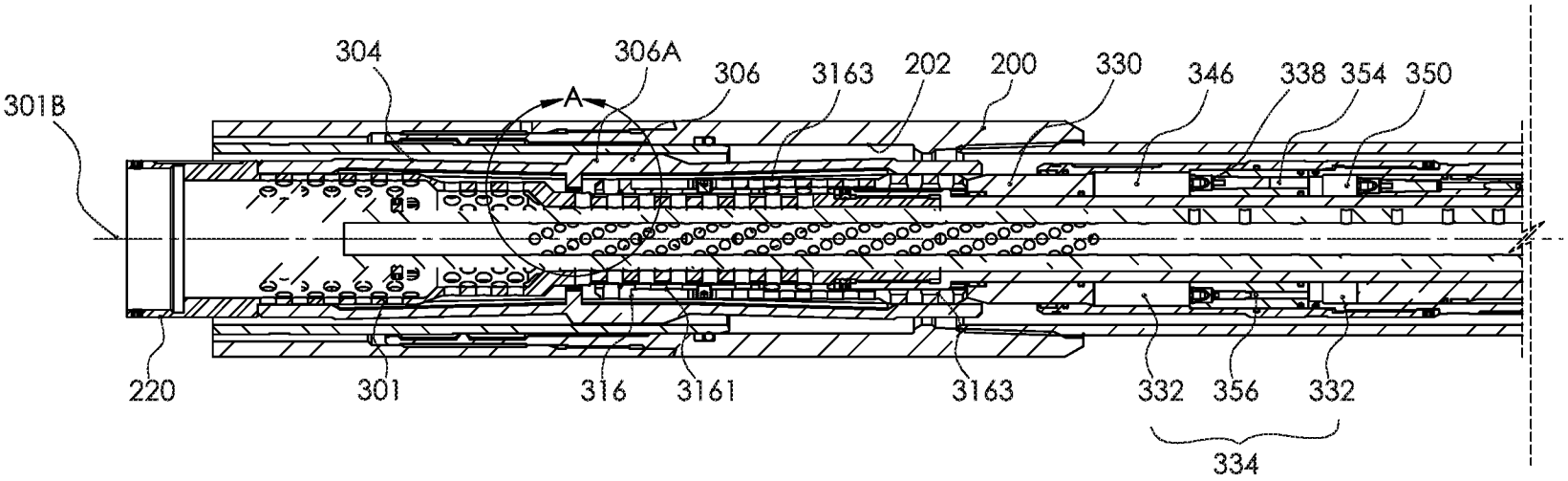
FIG. 11A is a sectional view of the third embodiment of a locator disposed in a condition while being run-in-hole within a wellbore.
Figure 11B:
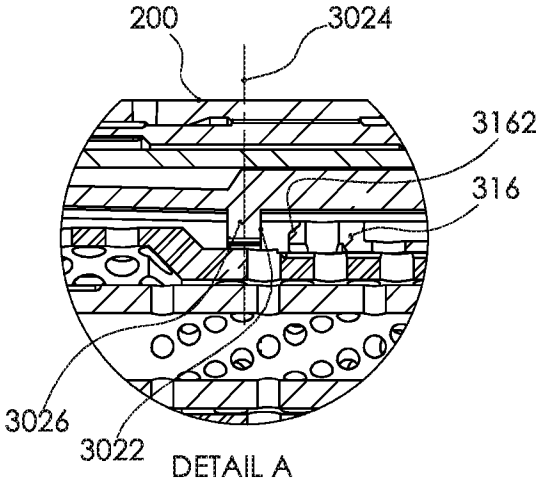
FIG. 11B is an enlarged view of Detail "A" in FIG. 11A.

A locating operation using embodiments of the locator 300 illustrated in FIGS. 11 to 16, will now be described. Referring to FIG. 11, while the locator 300 is being run-in-hole into the wellbore 102, the wellbore coupler 302 slidably engages the wellbore string 200 in a compressed condition, and is subjected to frictional drag forces exerted by the wellbore string 200, resulting in the wellbore coupler 302 being urged uphole, relative to the mandrel 308, by the frictional drag forces. Co-operatively, the wellbore coupler retainer 310B limits uphole displacement of the wellbore coupler 302, relative to the conveyance member 301, that is being urged by these frictional drag forces, thereby rendering the wellbore coupler 302 translatable with the conveyance member 301 in a downhole direction by virtue of the urging of the displacement of the wellbore coupler 302, in a downhole direction, by the wellbore coupler retainer member 310B. In parallel, the engagement member 306 is maintained in a spaced apart relationship relative to the displacement hindering member 316 by the displacement hindering member retainer 3082.

Figure 12A:
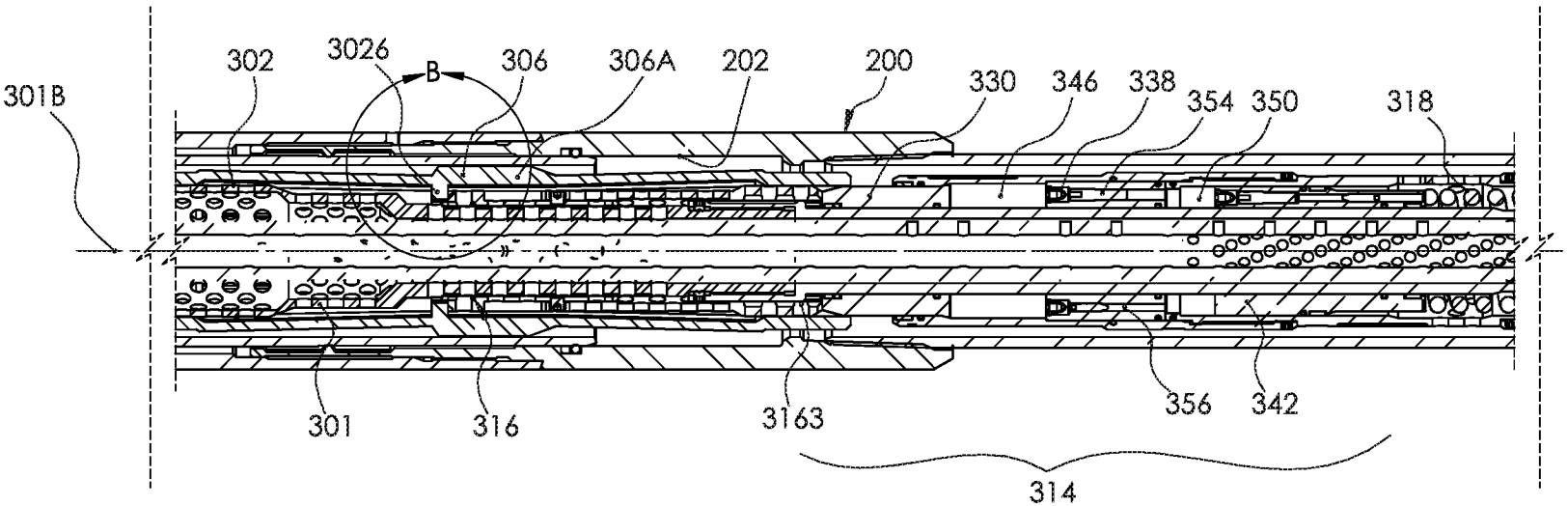
FIG. 12A is a sectional view of the third embodiment of a locator disposed in a condition while being pulled-out-of-hole within a wellbore, and while the wellbore coupler is disposed in a released position.
Figure 12B:
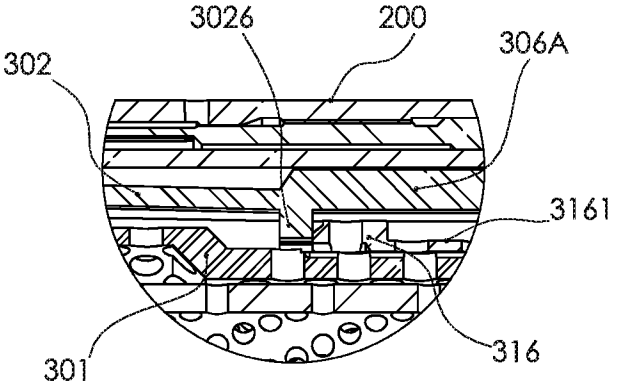
FIG. 12B is an enlarged view of Detail "B" in FIG. 12A.
Figure 13A:
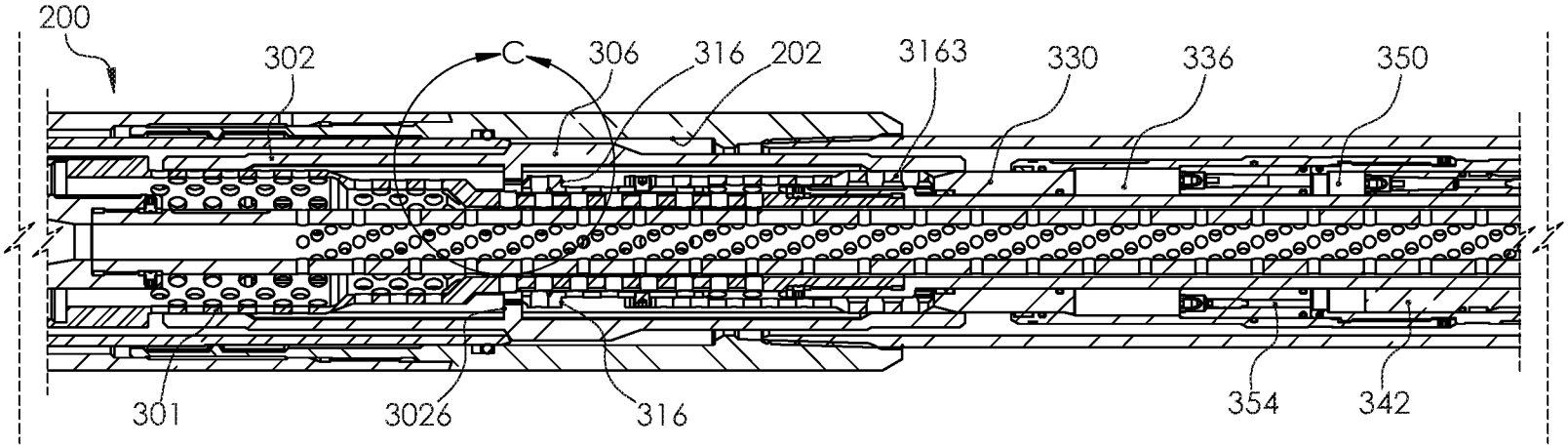
FIG. 13A is a sectional view of the third embodiment of a locator disposed in a condition while being pulled-out-of-hole within a wellbore, while the engagement member of the wellbore coupler is disposed in the locating position, but without a force being applied by the mandrel urging displacement of the engagement member of the wellbore coupler to the retracted position; and without the engagement surface of the displacement hindering member having become oriented to oppose displacement of the wellbore coupler to the released position.
Figure 13B:
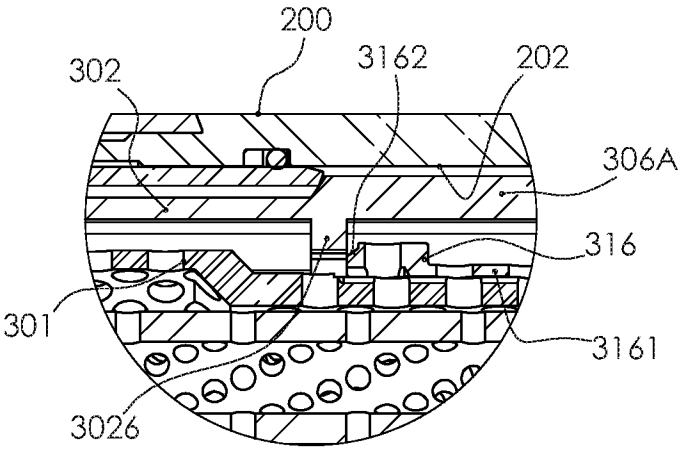
FIG. 13B is an enlarged view of Detail "C" in FIG. 13A.
Figure 14A:
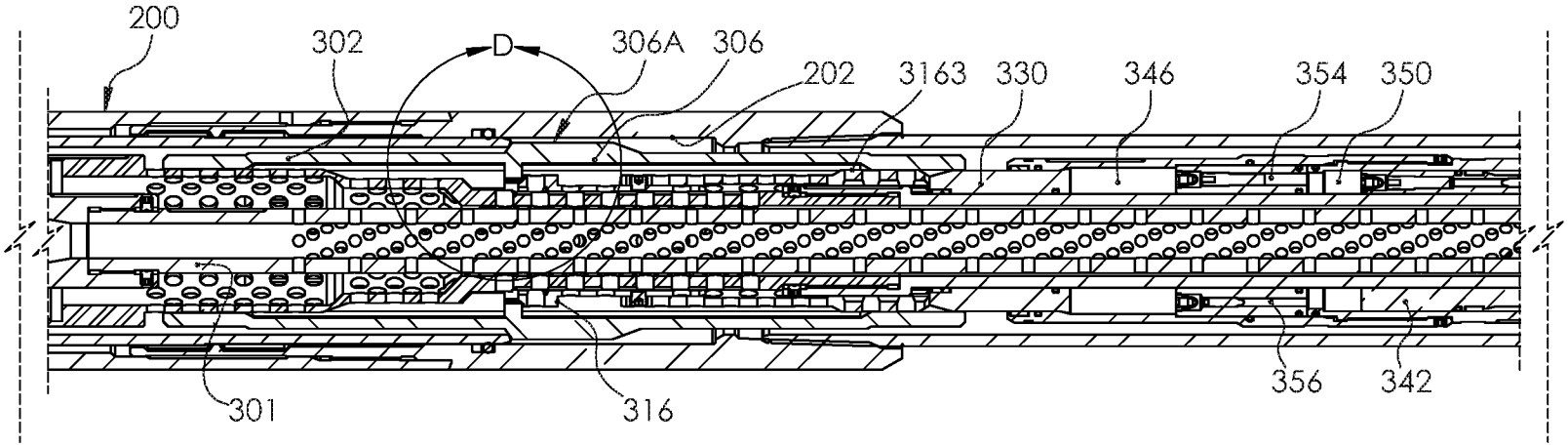
FIG. 14A is a sectional view of the third embodiment of a locator disposed in a condition while being pulled-out-of-hole within a wellbore, while the engagement member of the wellbore coupler is disposed in the locating position and the engagement surface of the displacement resistor is oriented to prevent displacement of the engagement member to the retracted position, but without a force being applied by the mandrel urging displacement of the wellbore coupler to the retracted position.
Figure 14B:
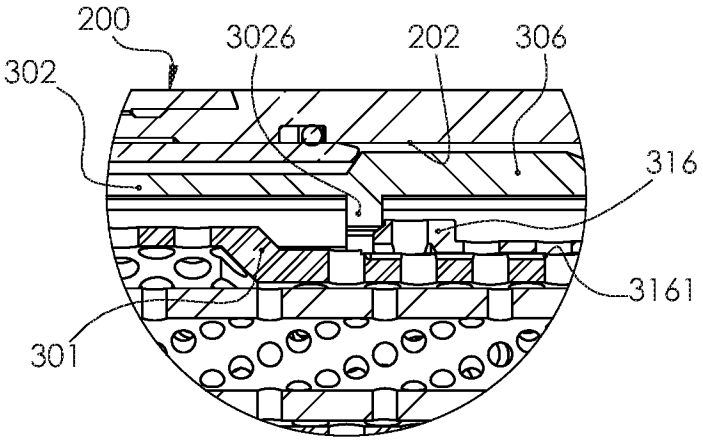
FIG. 14B is an enlarged view of Detail "D" in FIG. 14A.

Upon moving past the general area where locating is intended, the workstring 220 reverses direction and is then pulled uphole, along with the conveyance member 301. By virtue of its engagement with the first pusher 330, the displacement hindering member 316, likewise, is pulled uphole. Similarly, by virtue of its engagement with the displacement hindering member 316, the wellbore coupler 302 (including the engagement member 306) is also pulled uphole. Referring to FIGS. 12-14, while the locator 300 is being pulled uphole, upon alignment of the engagement member 306 with the locate profile 202, the collet springs 304 expands such that the engagement member 306 becomes disposed within the locate profile 202. In this configuration, the engagement member 306 is disposed in the locating position.

Figure 15A:
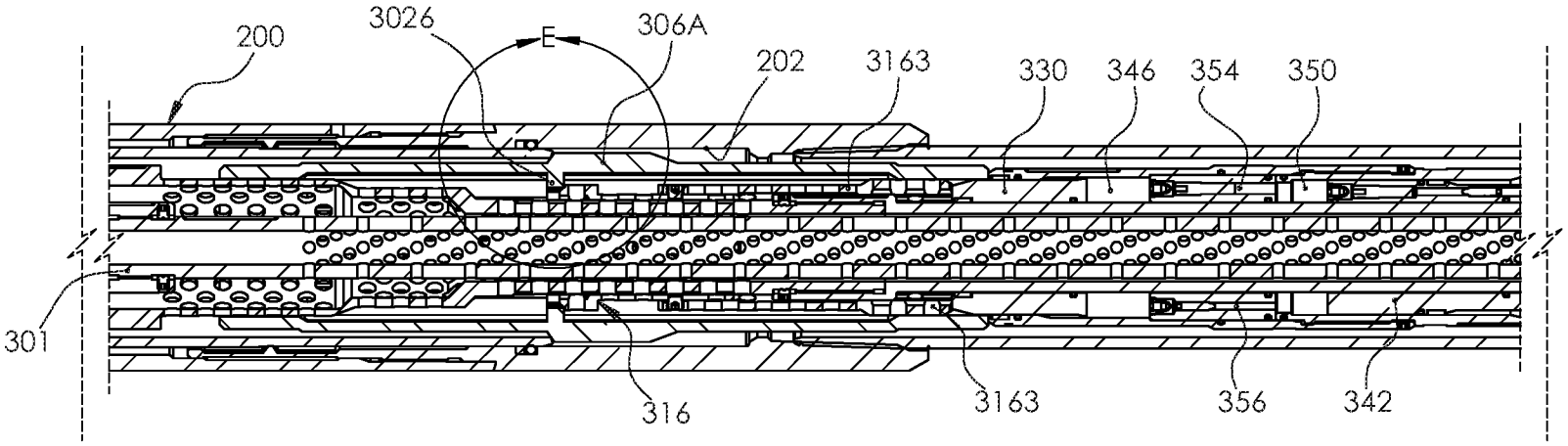
FIG. 15A is a sectional view of the third embodiment of a locator disposed in a condition while being pulled-out-of-hole within a wellbore, and while: (i) the engagement member of the wellbore coupler is disposed in the locating position, (ii) the mandrel is applying a force urging displacement of the engagement member to the retracted position, and (iii) the displacement hindering member is preventing such displacement.
Figure 15B:
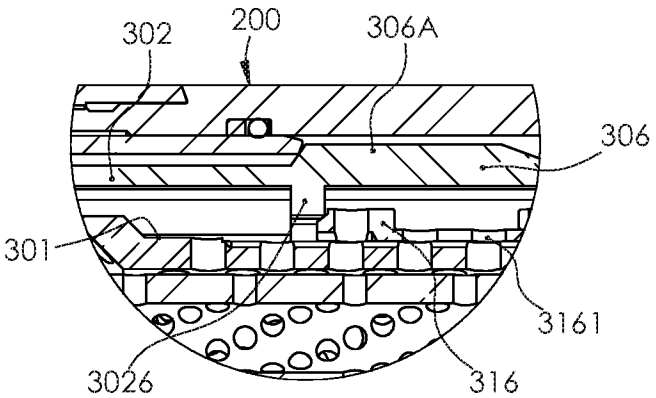
FIG. 15B is an enlarged view of Detail "E" in FIG. 15A.

Upon the engagement member 306 becoming disposed within the locate profile 202, further application of a pulling force to the workstring 300 results in displacement of the conveyance member 301 relative to the engagement member 306 until the wellbore coupler 302 shoulders on the collar 310A (see FIG. 15A). Either before (see FIG. 14A) or at the time the wellbore coupler 302 shoulders on the collar 310A, the engagement surface 3162 of the displacement hindering member 316 becomes disposed in engagement with the engagement surface 3022 of the wellbore coupler 302. In those embodiments where the engagement surface 3162 of the displacement hindering member 316 becomes disposed in engagement with the engagement surface 3022 of the wellbore coupler 302 prior to the shouldering of the wellbore coupler 302 on the collar 310A (see FIGS. 14A and 14B), because the displacement hindering member 310 is disposed in engagement with the wellbore coupler 302 (more specifically, the protuberance 3026), as further uphole pulling force is applied, the displacement hindering member 316, via the first pusher 330, urges displacement of the fluid 332 within the fluid conductor, from the first compartment 346 to the second compartment 350, with effect that the second pusher 342 is displaced and urges compression of the biasing member 341.

Upon the shouldering of the wellbore coupler 302 on the collar 310 (see FIG. 15A), application of an uphole pulling force on the workstring 220 results in transmission of the uphole pulling force to the wellbore coupler 302. If the transmitted force is sufficient, the protuberance 3026 is caused to slide downwardly (towards the central longitudinal axis of the conveyance member 301) against the engagement surface 3162 of the displacement hindering member 316. In parallel, contraction of the engagement member 306 is effected. In order to effect the contraction of the wellbore coupler, the transmitted force is sufficient to overcome at least the combination of: (i) the force resisting relative movement between the wellbore coupler 302 (i.e. locator block 306A) and the locate profile 202, (ii) the spring force of the wellbore coupler 302, (iii) the force resisting relative movement between the engagement member 306 and the displacement hindering member 316, (iv) the force being applied by the resilient member 318, and (v) the force resulting from hydraulic pressure within the first compartment 346.

While the protuberance 3026 is slidingly downwardly, the displacement hindering member 316 is urged against the first pusher 330, effecting displacement of the fluid 332 within the fluid conductor, from the first compartment 346 to the second compartment 350, with effect that the second pusher 342 becomes displaced and urges compression of the biasing member 341. By virtue of the fluid displacement, the relative displacement, between the engagement member 306 and the displacement hindering member 316, is impeded.

Figure 16A:
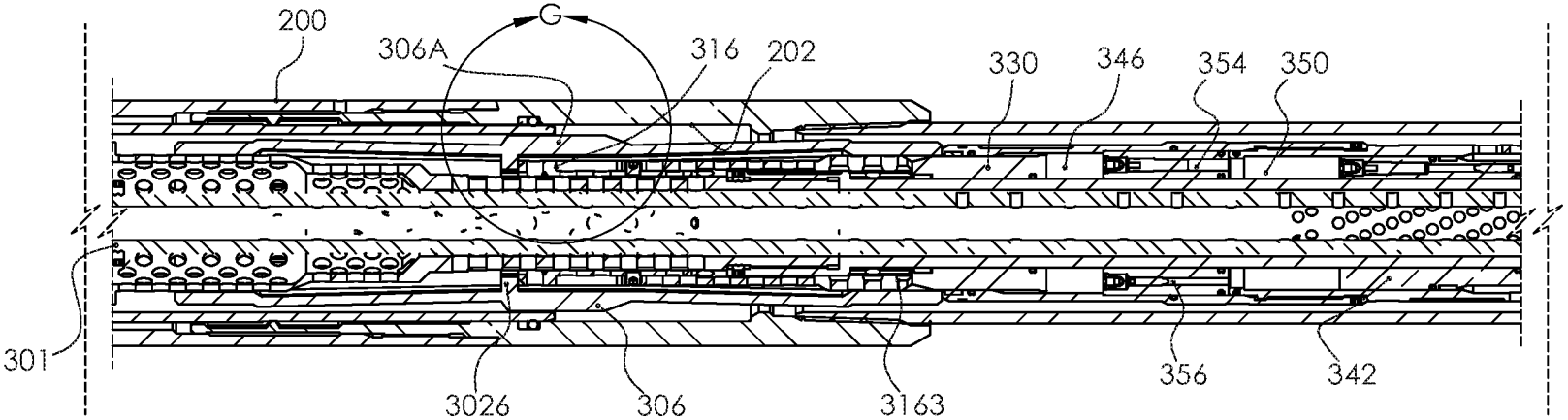
FIG. 16A is a sectional view of the third embodiment of a locator disposed in a condition while being pulled-out-of-hole within a wellbore, and while the engagement member is disposed in the retracted position, after having been released from a locate profile.
Figure 16B:
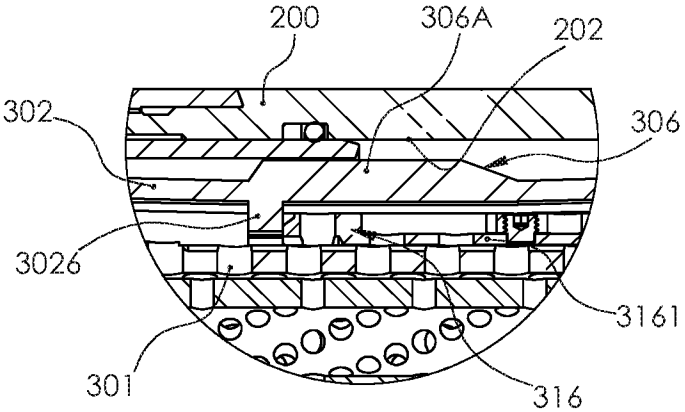
FIG. 16B is an enlarged view of Detail "G" in FIG. 16A.

Eventually, the protuberance 3026 loses contact with the engagement surface 3162, resulting in a stepwise reduction in force for effecting the displacement of the engagement member 306 from the locating position to the retracted position (i.e. the release of the engagement member 306 from retention within the locate profile 202), such that a relatively weak pulling up force is required to effect the displacement of the engagement member 306 to the retracted position (see FIGS. 16A and 16B). In the illustrated embodiment, this stepwise reduction is attributable to the fact that, instead of being required to overcome the frictional force opposing the movement of the engagement surface 3022 of the protuberance 3026 relative to the engagement surface 3162 of the displacement hindering member 316, the normal axis of which is disposed at an angle relative to axis of displacement along which the protuberance 3026 is being displaced towards the retracted position, the uphole pulling force is required to only overcome the frictional force opposing the movement of the engagement surface 3022 of the protuberance 3026 relative to a surface 3168 of the displacement hindering member 316 that is disposed parallel to, or substantially parallel to, the axis of displacement along which the protuberance 3026 is being displaced towards the released position, which is of a much smaller magnitude.

Once the engagement member 306 has become disposed in the retracted position, and has been displaced from alignment with the locate profile 302 (from which the engagement member 306 has just become retracted) the locator may be conducted uphole to effect locating with the next uphole locate profile 202, by pulling up on the workstring 220. As the workstring is pulled uphole, the first pusher 330, by virtue of its engagement to the displacement hindering member 316, urges the displacement of the displacement hindering member 316 in concert with the workstring 316. In parallel, by virtue of the engagement of the engagement member 306 to the displacement hindering member 316, the wellbore coupler 302 is also pulled uphole. Upon alignment with the next profile, the engagement member 306 becomes displaced, being urged by the bias of the collet springs 304.

Referring to the embodiments of the locator 300 illustrated in FIGS. 17A-D, 18A-C, 19A-C, and 20A-D, like the embodiments of the locator 300 illustrated in FIGS. 11 to 16, the impeding of the displacement of the engagement member 306, relative to the displacement hindering member 316, for effecting the change in condition of the engagement member 306 (in this case, the unseating of the engagement member 306) such that the engagement member 306 becomes displaceable to the retracted position, is effected by fluid flow resistance, as described above. Unlike the embodiments of the locator 300 illustrated in FIGS. 11 to 16, with the embodiments illustrated in FIGS. 17A-D, 18A-C, 19A-C, and 20A-D, the impeding of the displacement of the displacement hindering member 316, relative to the engagement member 306, while the displacement of the engagement member 306 to the retracted position is being prevented, for effecting a change in condition of the engagement member 306 such that the engagement member 306 becomes displaceable to the retracted position, is effected by engagement of the wellbore coupler 302 and the first pusher 330.

Figures 17A, 17B, 17C, 17D:
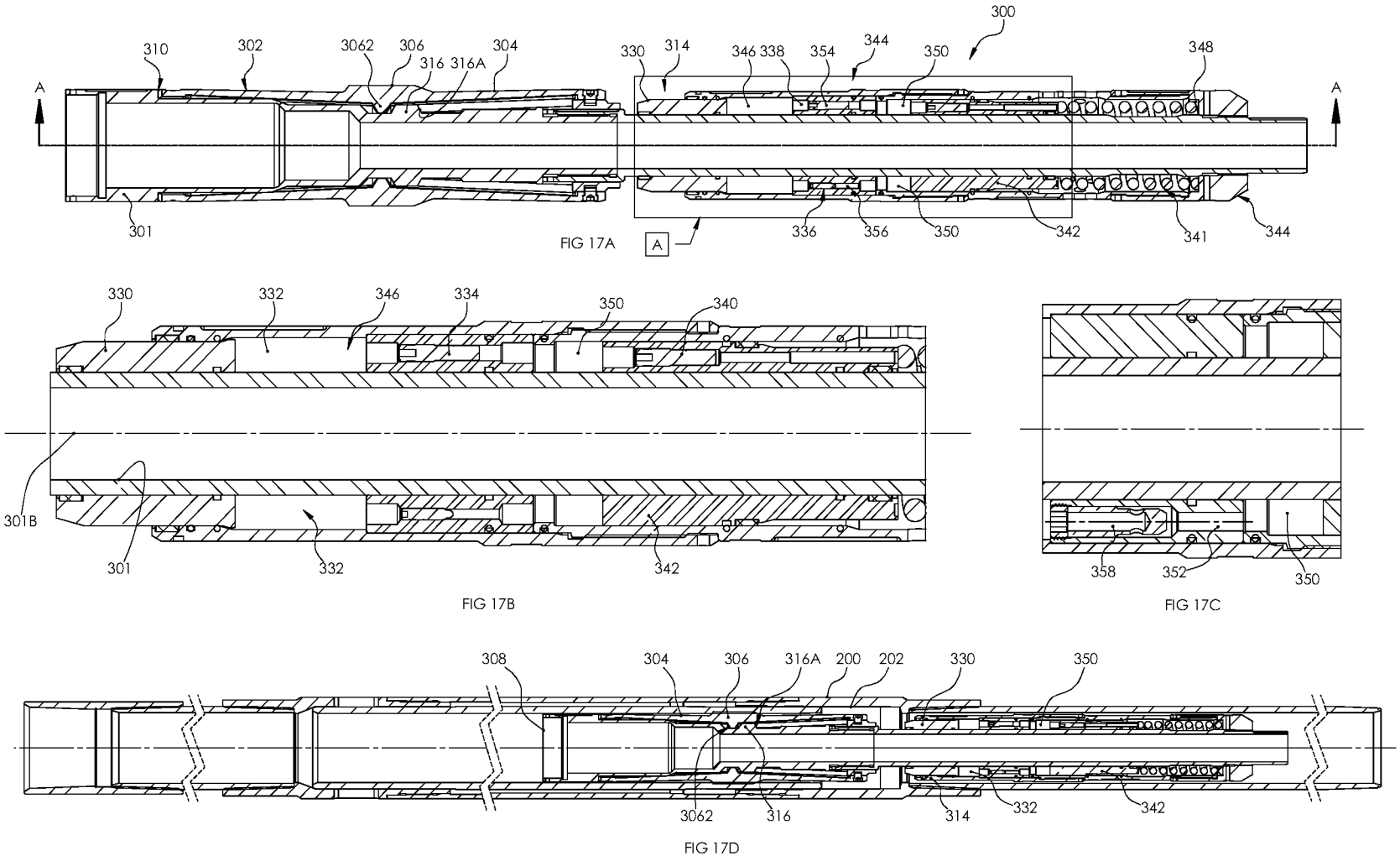
FIG. 17A is a sectional view of a fourth embodiment of a locator having been deployed within a wellbore and disposed in a run-in-hole condition.
FIG. 17B is an enlarged view of Detail "A" in FIG. 17A.
FIG. 17C is another sectional view of a fragment of the locator of FIG. 17A, taken along lines A-A, illustrating a portion of a displacement interference device of the locator.
FIG. 17D is an identical view of the locator in FIG. 17A, as deployed within a wellbore string.

In some of these embodiments, for example, in being conveyed through the wellbore 102, the wellbore coupler 302 is slidably mounted over the conveyance member 301. In some embodiments, for example, the conveyance member 301 includes a wellbore coupler retainer member 310 (such as, for example, in the form of a collar 310), for engaging the wellbore coupler 302. The wellbore coupler retainer member 310 is also provided and limits uphole displacement of the wellbore coupler 302, relative to the conveyance member 301, while the locator 300 is being run-in-hole with the workstring 220 through the wellbore 102. Referring to FIG. 17A, while being run-in-hole, the wellbore coupler 302 slidably engages the wellbore string 200 in a compressed condition, and is subjected to frictional drag forces exerted by the wellbore string 200, resulting in the wellbore coupler 302 being urged uphole, relative to the conveyance member 301, by the frictional drag forces. Co-operatively, the wellbore coupler retainer 310 limits uphole displacement of the wellbore coupler 302, relative to the conveyance member 301, that is being urged by these frictional drag forces, thereby rendering the wellbore coupler 302 translatable with the conveyance member 301 in a downhole direction by virtue of the urging of the displacement of the wellbore coupler 302, in a downhole direction, by the wellbore coupler retainer member 310. In some embodiments, for example the wellbore coupler retainer member 310 is defined by a shoulder formed in the conveyance member 301.

In some embodiments, for example, mounted to the conveyance member 301 is a force transmitter 314. The force transmitter 314 is configured to transmit an uphole pulling force, being applied to the conveyance member 301, from the conveyance member 301 to the wellbore coupler 302. The transmission of such an uphole pulling force, while the engagement member 306 is in the retracted position relative to the locate profile 202, effects displacement of the wellbore coupler 302, with the conveyance member 301, along an axis that is parallel, or substantially parallel, to the central longitudinal axis of the wellbore 102, or along an axis that is parallel, or substantially parallel, to the central longitudinal axis of the conveyance member 301, or both. As well, the transmission of such an uphole pulling force, while the engagement member 306 is unseated relative to the displacement hindering member 316 and disposed within the locate profile 202, in co-operation with the configuration of the locate profile 202, urges displacement of the engagement member 306 from the locating position to the retracted position such that the engagement member 306 becomes released from the locate profile 202.

After the engagement member 306 has become disposed within the locate profile 202, and while the engagement member 306 is unseated relative to the displacement hindering member 316 and disposed in a locating position within the locate profile 302, in some embodiments, for example, the displacement of the engagement member 306 from the locating position to the retracted position is along a displacement axis 3024 that is orthogonal, or substantially orthogonal, to the central longitudinal axis of the conveyance member 301, the central longitudinal axis of the wellbore 102, or both.

The displacement hindering member 316 is configured for preventing (such as, for example, blocking) displacement of the engagement member 306 to the retracted position. In some embodiments, for example, the prevention is effected by seating of an engagement surface 3022 of the wellbore coupler 302 on the displacement hindering member 316 (see FIGS. 18A-C). In some embodiments, for example, the engagement surface 3022 of the wellbore coupler 302 is disposed on a protuberance 3026. The protuberance 3026 is disposed on a side of the wellbore coupler 302 that is opposite to the side of the wellbore coupler 302 on which the engagement member 306 (such as another protuberance, such as, for example, the locator block 306A) is disposed. In some embodiments, for example, the protuberance 3026 extends inwardly relative to the central longitudinal axis of the conveyance member 301 (or, towards the central longitudinal axis of the conveyance member 301). In some embodiments, for example, the protuberance 3026 is aligned with the engagement member 306.

In some embodiments, for example, the displacement hindering member 316 extends from the conveyance member 301 in an outwardly direction relative to the central longitudinal axis of the conveyance member 301. In some embodiments, for example, the displacement hindering member 316 is integral with the conveyance member 301. In this respect, the displacement hindering member 316 translates with the conveyance member 301.

In some embodiments, for example, the displacement hindering member 316 includes a protuberance 316A that extends from the conveyance member 301 in an outwardly direction relative to the central longitudinal axis of the conveyance member 301.

In some embodiments, for example, the hindering member protuberance 316A is coupled to the conveyance member 301 with a frangible coupling 316B, such as a shear pin. This enables shearing of the protuberance 316A in the event that the wellbore coupler 302, while seated on the protuberance 316A, becomes friction locked within the wellbore, and thereby enable the locator 300 to continue moving within the wellbore 102.

In some embodiments, for example, the preventing of the displacement of the engagement member 306 from the locating position to the retracted position, by the displacement hindering member 316, is effected while the engagement member 306 is disposed within the locate profile 302.

In some embodiments, for example, the preventing of the displacement of the engagement member 306 from the locating position to the retracted position, by the displacement hindering member 316, is effected while the displacement hindering member 316 is disposed in alignment with the protuberance 3026, and, in some embodiments, for example, also while the displacement hindering member 316 is disposed in alignment with the locator block 306A.

In some embodiments, for example, the displacement hindering member 316 is configured for displacement relative to the protuberance 3026, for effecting unseating of the engagement member 306. In some embodiments, for example, the unseating is with effect that the displacement hindering member 316 becomes displaceable to the retracted position.

In some embodiments, for example, the displacement of the displacement hindering member 316, relative to the protuberance 3026, for effecting the unseating of the engagement member 306, is effectible by displacement of the displacement hindering member 316 along an axis that is transverse (such as, for example, orthogonal, or substantially orthogonal) to the normal axis of the engagement surface 3022.

In some embodiments, for example, the displacement of the displacement hindering member 316, relative to the protuberance 3026, for effecting unseating of the engagement member 306, is effectible by displacement of the displacement hindering member 316 along an axis that is transverse (e.g. orthogonal or substantially orthogonal) to the axis along which the engagement member 306 is displaceable between the locating and retracted positions.

In some embodiments, for example, the displacement of the displacement hindering member 316, relative to the protuberance 3026, for effecting unseating of the engagement member 306, is effectible by displacement of the displacement hindering member 316 along an axis that is parallel, or substantially parallel, to the central longitudinal axis of the conveyance member 301, or along an axis that is parallel, or substantially parallel, to the central longitudinal axis of the wellbore 102, or both.

As described above, the locator 300 is configured such that the displacement of the displacement hindering member 316 (such as, for example, in an uphole direction), relative to the protuberance 3026, for effecting unseating of the engagement member 306, is impeded. In this respect, the unseating of the protuberance 3026 is delayed, thereby providing more time for an operator at the surface to observe an indication that the locator block 306A has become releasably retained by the locate profile 202 (e.g. an increase in force required to displace the engagement member 306 from the locate profile 202).

In this respect, in some embodiments, for example, and as described above, the locator 300 further includes the fluid 332. The fluid 332 is disposed within the fluid conductor 334 for being displaced through the fluid conductor 334 by a reaction force that is responsive to a displacement-urging force that is urging the displacement of the displacement hindering member 316, relative to the engagement member 316 (e.g. the protuberance 3026), for effecting the unseating of the engagement member 306, such that a change in condition of the engagement member 306 is effected such that the engagement member 306 becomes displaceable to the retracted position.

The displacement of the fluid 332 includes conduction of the fluid 332 through the fluid conductor 334 for effecting the impeding of the displacement of the displacement hindering member 316 relative to the engagement member 306, while the displacement of the engagement member 306 to the retracted position is being prevented (e.g. by seating on the displacement hindering member 316), for effecting a change in condition of the engagement member 306 (e.g. the engagement member 316 becomes unseated) such that the engagement member 306 becomes displaceable to the retracted position In some embodiments, for example, after the unseating of the engagement member 306, the engagement member 306 is disposed in an unseated condition, and, in some of these embodiments, for example, the engagement member 306 is disposed downhole relative to the displacement hindering member 316 upon the unseating. In some of these embodiments, for example, the workstring 220 is pulled uphole so as to effect locating within another region of the wellbore 102, further uphole from the earlier locate. In order for the engagement member 306 to become releasably retained by an uphole locate profile 302, while introducing a delay to its release from such releasable retention from the locate profile 202, the engagement member 306 is displaced relative to the displacement hindering member 316, for effecting re-seating of the engagement member 306 on the displacement hindering member 316.

In this respect, and as described above in some embodiments, for example, the functionality of re-seating the engagement member 306 on the displacement hindering member 316 and the engagement member 306, for preventing the release of the engagement member 306 from retention by another locate profile 202, is combined with the functionality of impeding the displacement of the displacement hindering member 316, relative to the engagement member 306 for effecting the unseating of the engagement member 316, so that there is sufficient time for a positive indication of the locating of the wellbore coupler 302, effected by the preventing, to be detected uphole.

In this respect, the force transmitter 314, in addition to urging translation of the wellbore coupler 302 with the conveyance member 301 during uphole displacement of the conveyance member 301 through the wellbore 102, and enabling the impeding of the displacement of the displacement hindering member 316 relative to the engagement member 306 for effecting the unseating of the engagement member 306, also urges displacement of the wellbore coupler 302, relative to the displacement hindering member 316, for effecting seating (including re-seating) of the engagement member 306 on the displacement hindering member 316.

In this respect, and as described above, the force transmitter 314 includes the first pusher 330, the second pusher 342, and the fluid 332. As well, the fluid conductor 334 is provided and includes the first compartment 346, the second compartment 350, the first displacement-impeding fluid passage 354, the second displacement-impeding fluid passage 356, and the return fluid passage 352. As described above, the first and second displacement-impeding fluid passages are provided for conducting the fluid 332 while the fluid 332 is being displaced from the second compartment 350 to the first compartment 346, and the return passage 352 is provided for conducting the fluid 332 while the fluid 332 is being displaced from the first compartment 346 to the second compartment 350.

The force transmitter 314 is biased by the biasing member 341 for engaging the wellbore coupler 302 for urging the movement of wellbore coupler 302 (and, therefore, the engagement member 306) such that the engagement member 306 becomes displaced relative to the displacement hindering member 316 (such as, for example, in the uphole direction), while: the displacement hindering member 316 and the engagement member 306 are co-operatively disposed such that the engagement member 306 is unseated relative to the displacement hindering member 316, with effect that the engagement member 306 and the displacement hindering member 316 become co-operatively disposed such that the displacement of the engagement member 306 to the retracted position is prevented (for example, the engagement member 306 becomes seated upon the displacement hindering member 316).

In some embodiments, for example, the biasing member 341 is resilient. In some embodiments, for example, the biasing member includes a spring.

In some embodiments, for example, the force transmitter 314 is disposed within a housing 344 that is mounted to the conveyance member 301, with the biasing member 341 being retained by a biasing member retainer 348 defined within the housing 344.

The first pusher 330 is provided for becoming disposed in engagement with the wellbore coupler 302 for transmitting a displacement-urging force (e.g. the force being applied to the workstring while the workstring is being pulled uphole) being received by the conveyance member (and, therefore, the displacement hindering member 316) to the wellbore coupler 202.

The first pusher 330 is also provided for becoming disposed in engagement with the wellbore coupler 302 for being urged by the wellbore coupler 302 in response to movement (e.g. uphole) of the displacement hindering member 316 relative to the engagement member 306, in response to the application of a displacement-urging force, for effecting the unseating of the engagement member 306, the urging being with effect that the fluid 332 is conducted through the fluid conductor 334 such that the movement of the displacement hindering member 316 is impeded.

The first pusher 330 is also provided for becoming disposed in engagement with the wellbore coupler 302 for transmitting a biasing force received from the biasing member, via at least the second pusher 342 and the fluid 332.

The second pusher 342 is coupled (e.g. connected) to the biasing member 341 such that the biasing of the force transmitter 314 by the biasing member 341 is effected by the coupling of the second pusher 342 to the biasing member 341. In this respect, the second pusher 342 is disposed for effecting force transmission communication between the biasing member 341 and the fluid 332.

The fluid 332 is disposed, relative to the first and second pushers 330, 342 for effecting force transmission communication between the first and second pushers 330, 342. In some embodiments, for example, the fluid is disposed between the first and second pushers 330, 342, and, in this respect, the second pusher 342 is disposed between the fluid 332 and the biasing member 341.

The fluid 332 is disposed within the fluid conductor 334 and configured for:

(i) being displaced from the first compartment 346 to the second compartment 350 by a reaction force that is responsive to a displacement force that is urging the displacement of the displacement hindering member 316 relative to the engagement member 306 for effecting the unseating, while the engagement member 306 is seated on the displacement hindering member 316, and;

(ii) being displaced from the second compartment 350 to the first compartment 346 in response to the urging of the biasing member 341.

The reaction force overcomes at least the biasing force of the biasing member 341.

The engagement member 306, the displacement hindering member 316, the force transmitter 314, the biasing member 341, and the fluid conductor 334 are co-operatively configured such that:

the first pusher 330 urges displacement of the fluid 332 within the fluid conductor 334 with effect that: (i) the displacement of the displacement hindering member 316, relative to the engagement member 306, for effecting the change in condition of the engagement member 306 such that the engagement member 306 becomes displaceable to the retracted position, is impeded; and (ii) absorption of energy by the biasing member 341 is effected;

in response to the displacement of the displacement hindering member 316, relative to the engagement member, for effecting the change in condition of the engagement member 306 such that the engagement member 306 becomes displaceable to the retracted position.

In some of these embodiments, for example, the engagement member 306, the first pusher 330, the first compartment 346, the fluid 332, the second compartment 350, the second pusher 342, the first and second displacement-impeding fluid passages 354, 356, the return fluid passage 352, and the biasing member 341 are co-operatively configured such that:

the first pusher 330 is displaced within the first compartment 346 (for example, in a downhole direction) with effect that the volume of the space within the first compartment 346, that is available for occupation by the fluid 332, decreases;

the first pusher 330 urges displacement of the fluid 332 from the second compartment 350 to the first compartment 346 (via at least one of the first and second displacement-impeding fluid passages 354, 356) with effect that the relative displacement, between the engagement member 306 and the displacement hindering member 316, for effecting a change in condition of the engagement member 306 such that the engagement member 306 becomes displaceable to the retracted position, is impeded;

the second pusher 342 is displaced within the second compartment 350, with effect that the volume of the space within the second compartment 350, that is available for occupation by the fluid 332, increases;

compression of the biasing member 341 is being effected such that absorption of energy by the biasing member 341 is effected;

while: (i) the engagement member 306 is disposed within the locate profile 202 and seated on the displacement hindering member 316; (ii) the biasing member is extended from the compressed position (for example, the biasing member is disposed in the extended position); (iii) the displacement-urging force is being received by the displacement hindering member 316 (for example, the displacement-urging force is being transmitted from the workstring 220 to the displacement hindering member 316) such that the first pusher is applying the pusher force to the wellbore coupler 302; and (iv) the pusher force is being opposed (such as, for example, by the releasable retention of the engagement member 306 within the locate profile 202) with effect that a reaction force is applied to the first pusher 330.

In some embodiments, for example, after the engagement member 306 has become unseated relative to the displacement hindering member 316, a pulling up force applied to the workstring 220, in combination with the configuration of the locate profile 202 (see above), effects the displacement of the engagement member 306 from the locating position to the retracted position such that the engagement member 306 becomes released and the protuberance 3026 becomes disposed adjacent to and downhole relative to the displacement hindering member 316. This results in the wellbore coupler 302 being prevented from being displaced uphole, relative to the displacement hindering member 316 for effecting the seating (or re-seating) of the engagement member 306 on the displacement hindering member 316, such uphole displacement being urged by the biasing member 341 via the force transmitter 314. Because the collet springs 304 have collapsed, and the conveyance member 301 has moved further uphole such that the engagement member 306 is no longer in alignment with the locate profile 202, the biasing force of the collet springs 304, urging the displacement of the engagement member 306 to the locating position, is opposed by the wellbore string such that the engagement member 306 is prevented by the wellbore string from becoming displaced to the locating position, and such that disposition of the protuberance 3026 against the displacement hindering member 316, urged by the biasing member 341, is maintained In this respect, in some embodiments, for example, the displacement hindering member 316 includes a retainer surface 3164. In some embodiments, for example, the retainer surface 3164 includes a normal axis that is transverse (such as, for example, orthogonal, or substantially orthogonal) to the normal axis of the engagement surface 3162 of the displacement hindering member 316. The conveying member 301, the displacement hindering member 316, the engagement member 306, the force transmitter 314, and the biasing member 341 are co-operatively configured such that:

displacement of the engagement member 306 to the retracted position is effected;

in response to the urging of a displacement urging force being applied (for example, in an uphole direction) to the conveyance member 301 (and transmitted by the force transmitter 314), while the engagement member 306 is unseated relative to the displacement resistor 316 within a locate profile configured to co-operate with the urging of the displacement urging force for encouraging the displacement of the engagement member 306 to the retracted position; and the protuberance 3026 of the wellbore coupler becomes disposed, relative to the retainer surface 3164 of the displacement hindering member 316, such that the retainer surface 3164 prevents, or substantially prevents, displacement of the engagement member 306, relative to the displacement hindering member 316, (such as, for example, in an uphole direction, such as, for example, along an axis that is parallel, or substantially parallel, to the central longitudinal axis of the conveyance member 301, along an axis that is parallel, or substantially parallel, to the central longitudinal axis of the wellbore 102, or both) being urged by the biasing member 341 via the force transmitter 314, in response to a displacement of the conveying member 301 (such as in an uphole direction relative to the locate profile 202), relative to the locate profile 202, such that the engagement member 306 becomes aligned with an opposing surface of the wellbore 102 that is insufficiently spaced from the engagement member 306 such that there is insufficient clearance for receiving sufficient displacement of the engagement member 306, relative to the displacement hindering member 316, to clear the retainer surface 3164, while the biasing member 341 continues to urge displacement of the wellbore coupler 302 relative to the displacement hindering member 316 for effecting the seating of the engagement member 306 on the displacement hindering member 316.

While the protuberance 3026 is disposed, relative to the retainer surface 3164 of the displacement hindering member 316, such that the retainer surface 3164 opposes displacement of the engagement member 306, relative to the displacement hindering member 316, being urged by the biasing member 341 via the force transmitter 314, an uphole pulling force applied to the workstring 220 effects displacement of the conveyance member 301 in an uphole direction, and displacement of the wellbore coupler 302 is also effected in an uphole direction, in concert with the uphole displacement of the conveyance member 301.

Upon the engagement member 306 becoming disposed in alignment with another locate profile 202, the engagement member 306, owing to the bias exerted by the collet springs 304 in their compressed state, is displaced to the locating position, clearing the retainer surface 3164, and becoming disposed within the locate profile 202. In this respect, the displacement hindering member 316, the engagement member 306, the force transmitter 314, and the biasing member 341 are co-operatively configured such that:

displacement of the engagement member 306 to the locating position (such as, for example, in an outwardly direction relative to the central longitudinal axis of the conveyance member 301, or relative to the central longitudinal axis of the wellbore 102, or both) is effected such that the engagement member 306 becomes displaceable relative to the displacement hindering member 316 (such as, for example, along an axis that is parallel, or substantially parallel, to the central longitudinal axis of the conveyance member 301, along an axis that is parallel, or substantially parallel, to the central longitudinal axis of the wellbore 102, or both) by the biasing member 341 via the force transmitter 314;

in response to the removal of opposition (such as, for example, alignment with another locate profile 302) to the displacement of the engagement member 306 (such as, for example, in an outwardly direction relative to the central longitudinal axis of the conveyance member 301, or in an outwardly direction relative to the central longitudinal axis of the wellbore 102, or both) relative to the displacement hindering member 316 to the locating position for effecting clearance of the retainer surface 3164 by the engagement member 306 (for example, the relative displacement is for the engagement member 306 becoming disposed in the locating position), while the protuberance 3026 is disposed, relative to the retainer surface 3164 of the displacement hindering member 316, such that the retainer surface 3164 prevents displacement of the engagement member 306, relative to the displacement hindering member 316 (such as, for example, displacement along an axis that is parallel, or substantially parallel, to the central longitudinal axis of the conveyance member 301, or along an axis that is parallel, or substantially parallel, to the central longitudinal axis of the wellbore 102, or both) being urged by the biasing member 341 via the force transmitter 314.

Upon the clearing of the retainer surface 3164 and becoming disposed in the locating position within the locate profile 202, because of the urging of the biasing member 341, via the force transmitter 314, the engagement member 306 is displaced relative to the displacement hindering member 316 such that the engagement member 306 becomes seated on the displacement hindering member 316. In this respect, the displacement hindering member 316, the engagement member 306, the force transmitter 314, and the biasing member 341 are co-operatively configured such that:

displacement of the engagement member 306, relative to the displacement hindering member 316, is effected by the biasing member 341 via the force transmitter 314, such that the engagement member 306 becomes seated on the displacement hindering member 316;

in response to urging of the displacement of the engagement member, relative to the displacement hindering member 316, by the biasing member 341 via the force transmitter 314, while (i) the engagement member 306 is disposed in the locating position and engaged to the first pusher 330, (ii) the engagement member 306 in unseated relative to the displacement hindering member 316, and (iii) the biasing member 341 is disposed for releasing energy for effecting the urging.

In some of these embodiments, for example, the effected displacement of the displacement hindering member 316 relative to the engagement member 306 is effected for effecting co-operative disposition of the displacement hindering member 316 relative to the engagement member 306 such that displacement of the engagement member 306 to the retracted position is prevented or impeded, is a displacement in an uphole direction. In some embodiments, for example, the effected displacement is along an axis that is parallel to the central longitudinal axis 301B of the conveyance member 301, or along an an axis that is parallel to the central longitudinal axis of the wellbore, or both. In some embodiments, for example, the effected displacement is a displacement is a displacement along an axis that is transverse (such as orthogonal, or substantially orthogonal) to the axis 3024 along which the engagement member 306 is displaceable between the locating and retracted positions.

In some of these embodiments, for example, the wellbore coupler 302, the first pusher 330, the first compartment 346, the fluid 332, the second compartment 350, the second pusher 342, the one or more displacement-impeding fluid passages 354, 356, the return fluid passage 352, and the biasing member 341 are also co-operatively configured such that:

extension of the biasing member is effected;

the second pusher 342 is displaced within the second compartment 350, with effect that the volume of the space within the second compartment 350, that is available for occupation by the fluid 332, decreases;

the fluid 332 is displaced from the second compartment 350 to the first compartment 346 via at least the return fluid passage 352;

the first pusher 330 is displaced within the first compartment 346, with effect that the volume of the space within the first compartment 346, that is available for occupation by the fluid 332, increases;

the engagement member 306 is displaced, relative to the displacement hindering member 316, for effecting re-seating of the engagement member 306 on the displacement hindering member 316 such that displacement of the engagement member 306 to the retracted position is prevented;

in response to urging by the biasing member, while: (i) the engagement member 306 is engaged to the first pusher 330, (ii) the engagement member 306 is displaceable between the locating and retracted positions (i.e. the engagement member 306 is unseated relative to the displacement hindering member 316); and (iii) the biasing member 341 is disposed for releasing energy for effecting the urging.

A locating operation utilizing an embodiment of the locator 300 illustrated in FIGS. 17A-D, 18A-C, 19A-C, and 20A-D, will now be described. The locator 300 is conveyed downhole into the wellbore 102 with the conveyance member 301 via the workstring 220. When initially deployed into the wellbore, the engagement member 306 is disposed uphole relative to the displacement hindering member 306. Referring to FIGS. 17A-D, while being run-in-hole, the wellbore coupler 302 slidably engages the wellbore string 200 in a compressed condition, and is subjected to frictional drag forces exerted by the wellbore string 200, resulting in the wellbore coupler 302 being urged uphole, relative to the conveyance member 301, by the frictional drag forces. Co-operatively, the wellbore coupler retainer 310 limits uphole displacement of the wellbore coupler 302, relative to the conveyance member 301, that is being urged by these frictional drag forces, thereby rendering the wellbore coupler 302 translatable with the conveyance member 301 in a downhole direction by virtue of the urging of the displacement of the wellbore coupler 302, in a downhole direction, by the wellbore coupler retainer member 310. Upon moving past the general area where locating is intended, the workstring 220 reverses direction and is then pulled uphole, along with the conveyance member 301. By virtue of contact engagement with the displacement hindering member 316, the wellbore coupler 302, likewise, is pulled uphole.

Figure 18A:
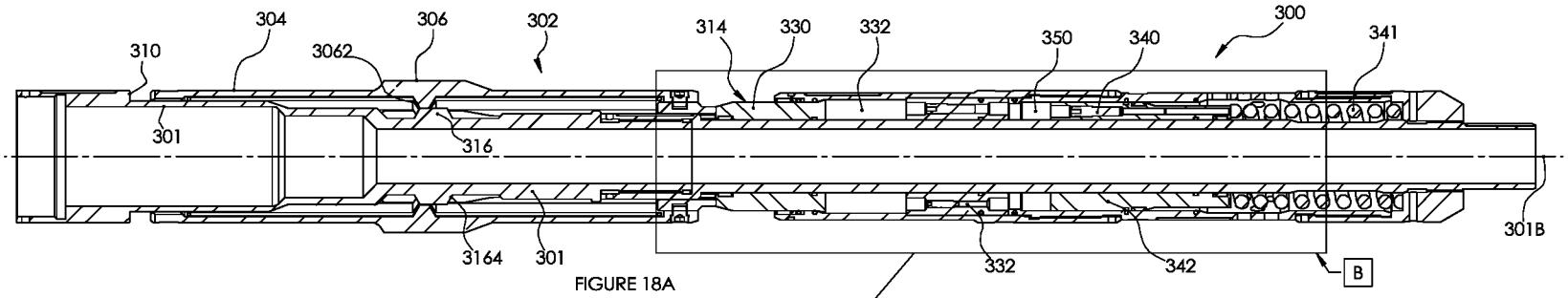
FIG. 18A is a sectional view of the fourth embodiment of the locator, having been deployed within a wellbore and disposed in a pull-out-of-hole ("POOH") condition, with the locator block being releasably engaged to the locate profile and the collet protuberance being seated on the keeper.
Figure 18B:
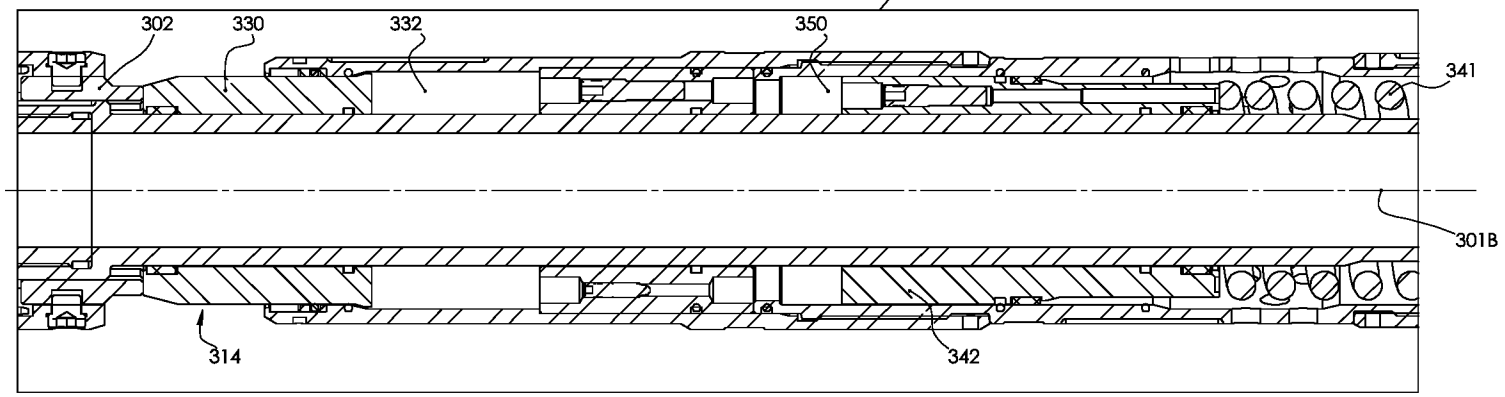
FIG. 18B is an enlarged view of Detail "B" in FIG. 18A.
Figure 18C:
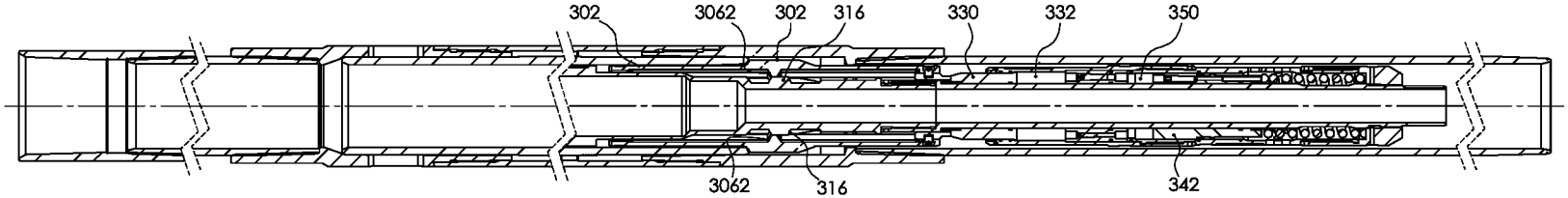
FIG. 18C is an identical view of the locator in FIG. 18A, as deployed within a wellbore string.
Figures 20A, 20B, 20C, 20D:
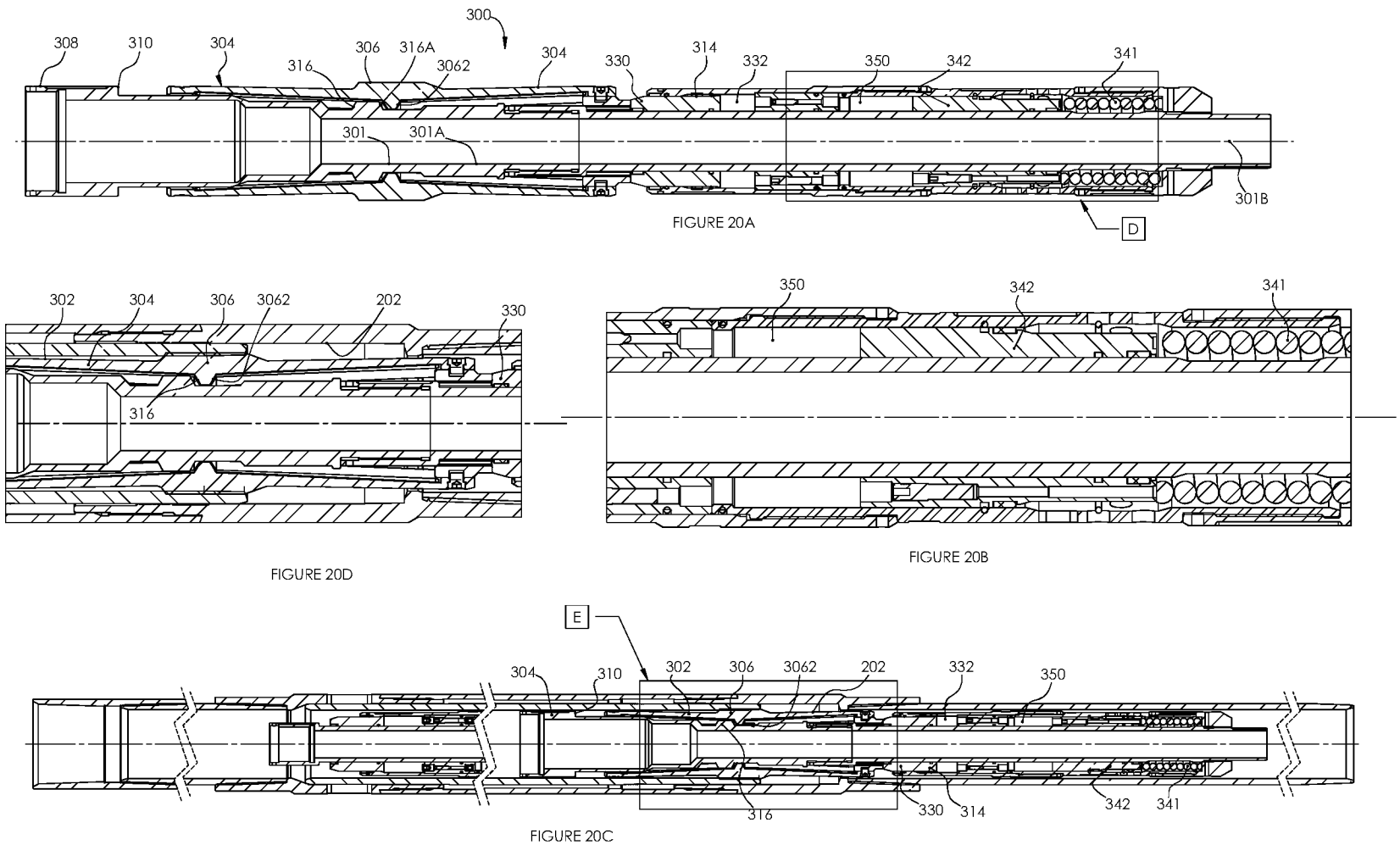
FIG. 20A is a sectional view of the fourth embodiment of the locator, having been deployed within a wellbore and disposed in a pull-out-of-hole ("POOH") condition, but further uphole relate to the condition of the locator in FIG. 19A, with the locator block having become disengaged from the locate profile and the collet having become disposed in a collapsed condition.
FIG. 20B is an enlarged view of Detail "D" in FIG. 20A.
FIG. 20C is an identical view of the locator in FIG. 20A, as deployed within a wellbore string.
FIG. 20D is an enlarged view of Detail "E" in FIG. 20C

While the workstring 220 is being pulled uphole, upon alignment with the locate profile 202, the engagement member 306 becomes displaced to the locating position such that the engagement member 306 becomes disposed within the locate profile 202, while the displacement hindering member 316 moves uphole relative to the engagement member 306 such that the engagement member 306 becomes seated on the displacement hindering member and disposed in a releasably retained condition within the locate profile 202 (see FIGS. 18A-C). In this state, the engagement member 306 is supported by the displacement hindering member 316 such that displacement of the engagement member 306, relative to the displacement hindering member 316, to the retracted position is prevented. Application of a further uphole pulling force causes the fluid 332 to be conducted between the first and second compartments 346, 350, resulting in compression of the biasing member, and impeding the displacement of the displacement hindering member 316 relative to the engagement member 306 (such as, for example, along an axis that is parallel, or substantially parallel to the central longitudinal axis of the conveyance member 301, or along an axis that is parallel, or substantially parallel to the central longitudinal axis of the wellbore 102, or both). Eventually, sufficient displacement of the displacement hindering member 316 relative to the engagement member 306 is effected such that the engagement member 306 becomes unseated (see FIGS. 19A-C). The fluid 332, the fluid conductor 334, the engagement member 306, and the displacement member 316 are configured such that fluid 332 continues to be conducted until at least the engagement member 306 has become unseated. At this point, application of a further uphole pulling force causes the engagement member 306 to be displaced from the locating position to the retracted position, with effect that the collet springs 304 collapse, the releasing of retention of the engagement member 306 is effected, and the engagement member 306 becomes disposed downhole of the displacement hindering member 316 and is urged against the retainer surface 3164 by the biasing member 341 via the force transmitter 314 (see FIGS. 20A-D). As the workstring 220 continues to be pulled uphole, the wellbore coupler 302 translates with the conveyance member 301 by virtue of contact engagement with the first pusher 330, and upon alignment with the next locate profile 202, owing to the bias of the collet springs 304, the engagement member 306 is displaced to the locating position within the locate profile, such that the engagement member 306 becomes displaceable relative to the displacement hindering member 316 by the biasing member 341 via the force transmitter 314. Once in this condition, displacement of the engagement member 306, relative to the displacement hindering member 316, is urged by the biasing member 341 relative to the displacement hindering member 316, such that the engagement member 306 becomes seated on the displacement hindering member 316.

Any one of the embodiments of the locator 300, described above, can be used for positioning a tool within a wellbore in order to perform a wellbore operation, such as perforating a casing, or sliding a sleeve for opening and closing a port in order to effect hydraulic fracturing and, subsequently, to receive hydrocarbons from a reservoir. In this respect, a method of performing a wellbore operation is provided including positioning a tool within the wellbore with the locator 300. The positioning includes effecting releasable retention of the engagement member 306 within a predetermined locate profile, and, after the positioning, actuating the tool for performing the wellbore operation.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A locator comprising:

a wellbore coupler including an engagement member that is biased by an engagement member biasing member for becoming disposed in a locating position within a locate profile within a wellbore; and a displacement impeding member for impeding displacement of the engagement member relative to the locate profile, while the engagement member is being supported by the displacement impeding member, wherein the displacement is for effecting retraction of the engagement member from the locate profile;

wherein:

the displacement impeding member is biased to disposition relative to the engagement member for effecting the impeding of the displacement of the engagement member to a retracted position;

the engagement member and the displacement impeding member are co-operatively configured such that:

the displacement impeding member is displaceable relative to the engagement member, while the displacement of the engagement member to the retracted position is being impeded, for effecting a change in condition of the engagement member such that the engagement member becomes displaceable to the retracted position; and overcoming of the bias of the displacement impeding member relative to the engagement member for effecting the impeding of the displacement of the engagement member to the retracted position is effected by urging of the displacement impeding member by the engagement member during displacement of the engagement member from the locating position to the retracted position.

2. The locator as claimed in claim 1;

wherein the impeding displacement is effected while the engagement member is engaged to the displacement impeding member.

3. The locator as claimed in claim 2;

wherein the impeding displacement is effected while the engagement member is seated on the displacement impeding member.

4. The locator as claimed in claim 3;

further comprising:

a conveyance member for coupling to a workstring for effecting movement of the locator within a wellbore;

wherein:

the engagement member is disposed in a locating position while disposed within the locate profile;

the engagement member is displaceable between the locating position and the retracted position; and the displacement of the engagement member, between the locating and retracted positions, is along an axis that is transverse to the central longitudinal axis of the conveyance member.

5. The locator as claimed in claim 1;

wherein:

the engagement member and the displacement impeding member are co-operatively configured such that:

the engagement member is urging the displacement of the displacement impeding member, relative to the engagement member, for effecting positioning of the displacement impeding member, relative to the engagement member, such that the effecting a change in condition of the engagement member, with effect that the engagement member becomes displaceable to the retracted position, is effected;

in response to urging of the displacement of the engagement member to the retracted position, while the displacement impeding member is preventing displacement of the engagement member to the retracted position.

6. The locator as claimed in claim 5;

wherein:

the preventing displacement of the engagement member to the retracted position is effected by engagement of the engagement member with an engagement surface of the displacement impeding member;

the displacement of the engagement member from the locating position to the retracted position is along a displacement axis; and the normal axis of the engagement surface of the displacement impeding member is disposed at an acute angle relative to the displacement axis.

7. The locator as claimed in claim 1:

wherein the displacement of the displacement impeding member relative to the engagement member is such that obstruction, by the displacement impeding member, of the retraction of the engagement member from the locate profile, is defeated.

8. The locator as claimed in claim 1;

wherein the engagement member and the displacement impeding member are co-operatively configured such that overcoming the bias of the displacement impeding member is with effect that the displacement impeding member is disposed relative to the engagement member such that the engagement member is displaceable to the retracted position.

9. A locator comprising:

a wellbore coupler including an engagement member that is biased towards a locating position for disposition within a locate profile, and configured for displacement between the locating position and a retracted position; and a displacement hindering member for preventing displacement of the engagement member to the retracted position;

wherein the displacement hindering member is biased to disposition relative to the engagement member for effecting the preventing of the displacement of the engagement member to the retracted position;

wherein the engagement member and the displacement hindering member are co-operatively configured such that:

the displacement hindering member is displaceable relative to the engagement member, while the displacement of the engagement member to the retracted position is being prevented, for effecting a change in condition of the engagement member such that the engagement member becomes displaceable to the retracted position; and overcoming of the bias of the displacement hindering member relative to the engagement member for effecting the preventing of the displacement of the engagement member to the retracted position is effected by urging of the displacement hindering member by the engagement member during displacement of the engagement member from the locating position to the retracted position.

10. The locator as claimed in claim 9;

further comprising a displacement resistance device;

wherein the displacement resistance device is configured for impeding of the displacement of the displacement hindering member relative to the engagement member for effecting a change in condition of the engagement member such that the engagement member becomes displaceable to the retracted position.

11. The locator as claimed in claim 10;

wherein the displacement resistance device, the engagement member, and the displacement hindering member are co-operatively configured such that, the impeding, by the displacement resistance device, of the displacement of the displacement hindering member relative to the engagement member, for effecting a change in condition of the engagement member such that the engagement member becomes displaceable to the retracted position, is absent or substantially absent upon the engagement member becoming displaceable to the retracted position.

12. The locator as claimed in claim 11;

wherein:

the displacement resistance device is configured to prevent, or substantially prevent, the displacement of the displacement hindering member relative to the engagement member, for effecting a change in condition of the engagement member such that the engagement member becomes displaceable to the retracted position, while the force urging the relative displacement is disposed below a predetermined minimum force; and the displacement resistance device includes a fluid and a valve member disposed in fluid communication with the fluid and configured for opening in response to pressure of the fluid exceeding a predetermined minimum pressure, wherein the fluid is disposed in force transmission communication with the locator such that the urging of the displacement of the displacement hindering member relative to the engagement member, for effecting a change in condition of the engagement member such that the engagement member becomes displaceable to the retracted position, effects an increase in pressure of the fluid, wherein the exceeding of a predetermined minimum pressure corresponds to the application of a force that is at or above the predetermined minimum force.

13. The locator as claimed in claim 12;

wherein the displacement resistance device includes a fluid conductor and fluid configured for being conducted through the fluid conductor for effecting the impeding of the displacement of the displacement hindering member relative to the engagement member, while the displacement of the displacement hindering member relative to the engagement member, for effecting a change in condition of the engagement member such that the engagement member becomes displaceable to the retracted position, is being urged.

14. The locator as claimed in claim 9;

further comprising:

a fluid conductor; and a fluid disposed within the fluid conductor for being displaced through the fluid conductor in response to urging of the displacement of the displacement hindering member relative to the engagement member, for effecting a change in condition of the engagement member such that the engagement member becomes displaceable to the retracted position.

15. The locator as claimed in claim 14;

wherein the fluid conductor includes a flow restrictor.

16. The locator as claimed in claim 15;

wherein the engagement member, the fluid conductor, the fluid and the displacement hindering member are cooperatively configured such that:

displacement of the displacement hindering member relative to the engagement member, for effecting a change in condition of the engagement member such that the engagement member becomes displaceable to the retracted position, is effected; and displacement of the fluid through the fluid conductor is effected, with effect that the displacement of the displacement hindering member relative to the engagement member, for effecting a change in condition of the engagement member such that the engagement member becomes displaceable to the retracted position, is impeded;

in response to: (a) application of a displacement-urging force that is urging the displacement of the displacement hindering member relative to the engagement member, for effecting a change in condition of the engagement member such that the engagement member becomes displaceable to the retracted position, and (b) application of a reaction force to the fluid, wherein the reaction force is responsive to the displacement-urging force, wherein both of (a) and (b) are effected while the displacement hindering member is preventing the displacement of the engagement member to the retracted position;

wherein the displacement of the fluid through the fluid conductor is effected by the reaction force.

17. The locator as claimed in claim 16;

further comprising:

a valve member disposed in fluid communication with the fluid and configured for opening in response to pressure of the fluid exceeding a predetermined minimum pressure, wherein the fluid is disposed for increasing in pressure in response to the urging of the displacement of the displacement hindering member, relative to the engagement member, while the displacement of the engagement member to the retracted position is being prevented, for effecting a change in condition of the engagement member such that the engagement member becomes displaceable to the retracted position, wherein the exceeding of a predetermined minimum pressure corresponds to the application of a force that is at or above the predetermined minimum force;

wherein, in response to the opening of the valve member, the fluid becomes displaceable through the fluid conductor.

18. The locator as claimed in claim 17;

wherein the engagement member, the fluid conductor, the fluid and the displacement hindering member are cooperatively configured such that:

displacement of the displacement hindering member relative to the engagement member, while the displacement of the engagement member to the retracted position is being prevented, for effecting a change in condition of the engagement member such that the engagement member becomes displaceable to the retracted position, is effected; and displacement of the fluid through the fluid conductor is effected, with effect that the displacement of the displacement hindering member relative to the engagement member, while the displacement of the engagement member to the retracted position is being prevented, for effecting a change in condition of the engagement member such that the engagement member becomes displaceable to the retracted position, is impeded;

in response to: (a) application of a displacement-urging force that is urging the displacement of the displacement hindering member relative to the engagement member, while the displacement of the engagement member to the retracted position is being prevented, for effecting a change in condition of the engagement member such that the engagement member becomes displaceable to the retracted position, and (b) application of a reaction force to the fluid, wherein the reaction force is responsive to the displacement-urging force and is sufficient for effecting the exceeding of the predetermined minimum pressure of the fluid such that the opening of the valve member is effected, wherein both of (a) and (b) are effected while the displacement hindering member is preventing the displacement of the engagement member to the retracted position;

wherein the displacement of the fluid through the fluid conductor is effected by the reaction force.

19. The locator as claimed in claim 18;

wherein displaceability of the displacement hindering member, relative to the engagement member, while the displacement of the engagement member to the retracted position is being prevented, for effecting a change in condition of the engagement member such that the engagement member becomes displaceable to the retracted position, is effected by displaceability of the displacement hindering member relative to the engagement member along an axis that is transverse to the axis along which the engagement member is displaceable between the locating and retracted positions.

20. The locator as claimed in claim 9;

wherein:

the engagement member and the displacement hindering member are co-operatively configured such that: the engagement member is urging the displacement of the displacement hindering member, relative to the engagement member, for effecting positioning of the displacement hindering member, relative to the engagement member, such that the effecting a change in condition of the engagement member, with effect that the engagement member becomes displaceable to the retracted position, is effected;

in response to urging of the displacement of the engagement member to the retracted position, while the displacement hindering member is preventing displacement of the engagement member to the retracted position.

21. The locator as claimed in claim 20;

wherein:

the preventing displacement of the engagement member to the retracted position is effected by engagement of the engagement member with an engagement surface of the displacement hindering member;

the displacement of the engagement member from the locating position to the retracted position is along a displacement axis; and the normal axis of the engagement surface of the displacement hindering member is disposed at an acute angle relative to the displacement axis.

22. The locator as claimed in claim 9;

further comprising a displacement hindering member biasing member for urging the displacement of the displacement hindering member relative to the engagement member, for effecting co-operative disposition of the displacement hindering member relative to the engagement member such that displacement of the engagement member to the retracted position is prevented.

23. The locator as claimed in claim 22;

wherein the displacement of the displacement hindering member relative to the engagement member, for effecting co-operative disposition of the displacement hindering member relative to the engagement member such that displacement of the engagement member to the retracted position is prevented, is effected while the engagement member is displaceable between the retracted and locating positions.

24. The locator as claimed in claim 9;

further comprising:

a force transmitter, including:

a first pusher for engaging the wellbore coupler;

a second pusher; and a fluid disposed, relative to the first and second pushers, for effecting force transmission communication between the first and second pushers;

a displacement hindering member biasing member for urging, via the force transmitter, the displacement of the displacement hindering member relative to the engagement member, for effecting co-operative disposition of the displacement hindering member relative to the engagement member such that displacement of the engagement member to the retracted position is prevented;

wherein the second pusher is disposed for effecting force transmission communication between the displacement hindering member biasing member and the fluid;

and a fluid conductor for conducting the fluid;

wherein the engagement member, the displacement hindering member, the force transmitter, the displacement hindering member biasing member, and the fluid conductor are co-operatively configured such that the first pusher urges displacement of the fluid within the fluid conductor with effect that:

(i) the displacement of the displacement hindering member relative to the engagement member, is impeded; and (ii) absorption of energy by the displacement hindering member biasing member is effected, wherein both of (i) and (ii) are effected in response to the displacement of the displacement hindering member relative to the engagement member, while the displacement of the engagement member to the retracted position is being prevented, for effecting a change in condition of the engagement member such that the engagement member becomes displaceable to the retracted position;

and the displacement of the displacement hindering member, relative to the engagement member, is effected for effecting co-operative disposition of the displacement hindering member relative to the engagement member such that displacement of the engagement member to the retracted position is prevented, in response to the urging by the displacement hindering member biasing member, via the force transmitter, while: (i) the displacement hindering member is engaged to the first pusher, and (ii) the displacement hindering member biasing member is disposed for releasing energy for effecting the urging.

25. The locator as claimed in claim 24;

wherein the displacement of the displacement hindering member, relative to the engagement member, with effect that the engagement member and the displacement hindering member become co-operatively disposed such that the displacement of the engagement member to the retracted position is prevented, is effected while the engagement member is displaceable between the locating and retracted positions.

26. The locator as claimed in claim 9;

wherein the engagement member and the displacement hindering member are co-operatively configured such that overcoming the bias of the displacement hindering member is with effect that the displacement hindering member is disposed relative to the engagement member such that the engagement member is displaceable to the retracted position.

27. A locator comprising:

a wellbore coupler that defines a unitary body including an engagement portion and a biasing portion, wherein the biasing portion is for biasing the engagement portion for becoming disposed in a locating position within a locate profile within a wellbore; and a displacement impeding member that is biased to disposition relative to the engagement portion for impeding displacement of the engagement portion relative to the locate profile, while the engagement portion is being supported by the displacement impeding member, wherein the displacement is for effecting retraction of the engagement portion from the locate profile;

wherein the engagement portion and the displacement impeding member are co-operatively configured such that overcoming of the bias of the displacement impeding member relative to the engagement portion for effecting the impeding of the displacement of the engagement portion is effected by urging of the displacement impeding member by the engagement portion during displacement of the engagement portion from the locating position.

28. The locator as claimed in claim 27;

wherein the impeding displacement is effected while the engagement portion is engaged to the displacement impeding member.

29. The locator as claimed in claim 28;

wherein the impeding displacement is effected while the engagement portion is seated on the displacement impeding member.

30. The locator as claimed in claim 29;

further comprising:

a conveyance member for coupling to a workstring for effecting movement of the locator within a wellbore;

wherein:

the engagement portion is disposed in a locating position while disposed within the locate profile;

the engagement portion is displaceable between the locating position and the retracted position; and displaceability of the engagement portion, between the locating and retracted positions, is along an axis that is transverse to the central longitudinal axis of the conveyance member.

31. The locator as claimed in claim 27;

wherein the unitary body of the wellbore coupler is defined by a collet.

32. The locator as claimed in claim 27;

wherein the engagement portion and the displacement impeding member are co-operatively configured such that overcoming the bias of the displacement impeding member is with effect that the displacement impeding member is disposed relative to the engagement portion such that the engagement portion is retractable from the locate profile.

33. A locator comprising:

a wellbore coupler that defines a unitary body including an engagement portion and a biasing portion, wherein the biasing portion is for biasing the engagement portion towards a locating position for disposition within a locate profile, and configured for displacement between the locating position and a retracted position;

a displacement hindering member that is biased to disposition relative to the engagement member for preventing displacement of the engagement portion to the retracted position;

wherein the engagement portion and the displacement hindering member are co-operatively configured such that:

at least one of the engagement portion and the displacement hindering member is displaceable relative to the other one of the engagement portion and the displacement hindering member, while the displacement of the engagement portion to the retracted position is being prevented, for effecting a change in condition of the engagement portion such that the engagement portion becomes displaceable to the retracted position; and overcoming of the bias of the displacement hindering member relative to the engagement portion for effecting the preventing of the displacement of the engagement portion to the retracted position is effected by urging of the displacement hindering member by the engagement portion during displacement of the engagement portion from the locating position to the retracted position.

34. The locator as claimed in claim 33;

further comprising a displacement resistance device;

wherein the displacement resistance device is configured for impeding of the displacement of the at least one of the engagement portion and the displacement hindering member relative to the other one of the engagement portion and the displacement hindering member for effecting a change in condition of the engagement portion such that the engagement portion becomes displaceable to the retracted position.

35. The locator as claimed in claim 34;

wherein the displacement resistance device, the engagement portion, and the displacement hindering member are co-operatively configured such that, the impeding, by the displacement resistance device, of the displacement of the at least one of the engagement portion and the displacement hindering member relative to the other one of the engagement portion and the displacement hindering member, for effecting a change in condition of the engagement portion such that the engagement portion becomes displaceable to the retracted position, is absent or substantially absent upon the engagement portion becoming displaceable to the retracted position.

36. The locator as claimed in claim 35;

wherein:

the displacement resistance device is configured to prevent, or substantially prevent, the displacement of the at least one of the engagement portion and the displacement hindering member relative to the other one of the engagement portion and the displacement hindering member, for effecting a change in condition of the engagement portion such that the engagement portion becomes displaceable to the retracted position, while the force urging the relative displacement is disposed below a predetermined minimum force; and the displacement resistance device includes a fluid and a valve member disposed in fluid communication with the fluid and configured for opening in response to pressure of the fluid exceeding a predetermined minimum pressure, wherein the fluid is disposed in force transmission communication with the locator such that the urging of the displacement of the at least one of the engagement portion and the displacement hindering member relative to the other one of the engagement portion and the displacement hindering member, for effecting a change in condition of the engagement portion such that the engagement portion becomes displaceable to the retracted position, effects an increase in pressure of the fluid, wherein the exceeding of a predetermined minimum pressure corresponds to the application of a force that is at or above the predetermined minimum force.

37. The locator as claimed in claim 36;

wherein the displacement resistance device includes a fluid conductor and fluid configured for being conducted through the fluid conductor for effecting the impeding of the displacement of the at least one of the engagement portion and the displacement hindering member relative to the other one of the engagement portion and the displacement hindering member, while the displacement of the at least one of the engagement portion and the displacement hindering member relative to the other one of the engagement portion and the displacement hindering member, for effecting a change in condition of the engagement portion such that the engagement portion becomes displaceable to the retracted position, is being urged.

38. The locator as claimed in claim 33;

further comprising:

a fluid conductor; and a fluid disposed within the fluid conductor for being displaced through the fluid conductor in response to urging of the displacement of the at least one of the engagement portion and the displacement hindering member relative to the other one of the engagement portion and the displacement hindering member, for effecting a change in condition of the engagement portion such that the engagement portion becomes displaceable to the retracted position.

39. The locator as claimed in claim 38;

wherein the fluid conductor includes a flow restrictor.

40. The locator as claimed in claim 39;

wherein the engagement portion, the fluid conductor, the fluid and the displacement hindering member are cooperatively configured such that:

displacement of at least one of the engagement portion and the displacement hindering member relative to the other one of the engagement portion and the displacement hindering member, for effecting a change in condition of the engagement portion such that the engagement portion becomes displaceable to the retracted position, is effected; and displacement of the fluid through the fluid conductor is effected, with effect that the displacement of the at least one of the engagement portion and the displacement hindering member relative to the other one of the engagement portion and the displacement hindering member, for effecting a change in condition of the engagement portion such that the engagement portion becomes displaceable to the retracted position, is impeded;

in response to: (a) application of a displacement-urging force that is urging the displacement of the at least one of the engagement portion and the displacement hindering member relative to the other one of the engagement portion and the displacement hindering member, for effecting a change in condition of the engagement portion such that the engagement portion becomes displaceable to the retracted position, and (b) application of a reaction force to the fluid, wherein the reaction force is responsive to the displacement-urging force, wherein both of (a) and (b) are effected while the displacement hindering member is preventing the displacement of the engagement portion to the retracted position;

wherein the displacement of the fluid through the fluid conductor is effected by the reaction force.

41. The locator as claimed in claim 40;

further comprising:

a valve member disposed in fluid communication with the fluid and configured for opening in response to pressure of the fluid exceeding a predetermined minimum pressure, wherein the fluid is disposed for increasing in pressure in response to the urging of the displacement of the at least one of the engagement portion and the displacement hindering member, relative to the other one of the engagement portion and the displacement hindering member, while the displacement of the engagement portion to the retracted position is being prevented, for effecting a change in condition of the engagement portion such that the engagement portion becomes displaceable to the retracted position, wherein the exceeding of a predetermined minimum pressure corresponds to the application of a force that is at or above the predetermined minimum force;

wherein, in response to the opening of the valve member, the fluid becomes displaceable through the fluid conductor.

42. The locator as claimed in claim 41;

wherein the engagement portion, the fluid conductor, the fluid and the displacement hindering member are cooperatively configured such that:

displacement of at least one of the engagement portion and the displacement hindering member relative to the other one of the engagement portion and the displacement hindering member, while the displacement of the engagement portion to the retracted position is being prevented, for effecting a change in condition of the engagement portion such that the engagement portion becomes displaceable to the retracted position, is effected; and displacement of the fluid through the fluid conductor is effected, with effect that the displacement of the at least one of the engagement portion and the displacement hindering member relative to the other one of the engagement portion and the displacement hindering member, while the displacement of the engagement portion to the retracted position is being prevented, for effecting a change in condition of the engagement portion such that the engagement portion becomes displaceable to the retracted position, is impeded;

in response to: (a) application of a displacement-urging force that is urging the displacement of the at least one of the engagement portion and the displacement hindering member relative to the other one of the engagement portion and the displacement hindering member, while the displacement of the engagement portion to the retracted position is being prevented, for effecting a change in condition of the engagement portion such that the engagement portion becomes displaceable to the retracted position, and (b) application of a reaction force to the fluid, wherein the reaction force is responsive to the displacement-urging force and is sufficient for effecting the exceeding of the predetermined minimum pressure of the fluid such that the opening of the valve member is effected, wherein both of (a) and (b) are effected while the displacement hindering member is preventing the displacement of the engagement portion to the retracted position;

wherein the displacement of the fluid through the fluid conductor is effected by the reaction force.

43. The locator as claimed in claim 42;

wherein the displaceability of at least one of the engagement portion and the displacement hindering member, relative to the other one of the engagement portion and the displacement hindering member, while the displacement of the engagement portion to the retracted position is being prevented, for effecting a change in condition of the engagement portion such that the engagement portion becomes displaceable to the retracted position, is effected by displaceability of the at least one of the engagement portion and the displacement hindering member relative to the other one of the engagement portion and the displacement hindering member along an axis that is transverse to the axis along which the engagement portion is displaceable between the locating and retracted positions.

44. The locator as claimed in claim 33;

wherein:

wherein the displaceability, of at least one of the engagement portion and the displacement hindering member, relative to the other one of the engagement portion and the displacement hindering member, while the displacement of the engagement portion to the retracted position is being prevented, for effecting a change in condition of the engagement portion such that the engagement portion becomes displaceable to the retracted position, is effected by displaceability of the displacement hindering member relative to the engagement portion; and the displacement hindering member is biased to disposition relative to the engagement portion for effecting the preventing of the displacement of the engagement portion to the retracted position.

45. The locator as claimed in claim 44;

wherein:

the engagement portion and the displacement hindering member are co-operatively configured such that:

the engagement portion is urging the displacement of the displacement hindering member, relative to the engagement portion, for effecting positioning of the displacement hindering member, relative to the engagement portion, such that the effecting a change in condition of the engagement portion, with effect that the engagement portion becomes displaceable to the retracted position, is effected;

in response to urging of the displacement of the engagement portion to the retracted position, while the displacement hindering member is preventing displacement of the engagement portion to the retracted position.

46. The locator as claimed in claim 45;

wherein:

the preventing displacement of the engagement portion to the retracted position is effected by engagement of the engagement portion with an engagement surface of the displacement hindering member;

the displacement of the engagement portion from the locating position to the retracted position is along a displacement axis; and the normal axis of the engagement surface of the displacement hindering member is disposed at an acute angle relative to the displacement axis.

47. The locator as claimed in claim 33;

further comprising a biasing member for urging the displacement of one of the engagement portion and the displacement hindering member relative to the other one of the engagement portion and the displacement hindering member, for effecting co-operative disposition of the displacement hindering member relative to the engagement portion such that displacement of the engagement portion to the retracted position is prevented.

48. The locator as claimed in claim 47;

wherein the displacement of the one of the engagement portion and the displacement hindering member relative to the other one of the engagement portion and the displacement hindering member, for effecting co-operative disposition of the displacement hindering member relative to the engagement portion such that displacement of the engagement portion to the retracted position is prevented, is effected while the engagement portion is displaceable between the retracted and locating positions.

49. The locator as claimed in claim 33;

further comprising:

a force transmitter, including:

a first pusher for engaging the wellbore coupler;

a second pusher; and a fluid disposed, relative to the first and second pushers, for effecting force transmission communication between the first and second pushers;

a biasing member for urging, via the force transmitter, the displacement of one of the engagement portion and the displacement hindering member relative to the other one of the engagement portion and the displacement hindering member, for effecting co-operative disposition of the displacement hindering member relative to the engagement portion such that displacement of the engagement portion to the retracted position is prevented;

wherein the second pusher is disposed for effecting force transmission communication between the biasing member and the fluid;

and a fluid conductor for conducting the fluid;

wherein the engagement portion, the displacement hindering member, the force transmitter, the biasing member, and the fluid conductor are co-operatively configured such that the first pusher urges displacement of the fluid within the fluid conductor with effect that:

(i) the displacement of the at least one of the engagement portion and the displacement hindering member relative to the other one of the engagement portion and the displacement hindering member, is impeded; and (ii) absorption of energy by the biasing member is effected, wherein both of (i) and (ii) are effected in response to the displacement of the at least one of the engagement portion and the displacement hindering member relative to the other one of the engagement portion and the displacement hindering member, while the displacement of the engagement portion to the retracted position is being prevented, for effecting a change in condition of the engagement portion such that the engagement portion becomes displaceable to the retracted position;

and the displacement of a one of the engagement portion and the displacement hindering member, relative to the other one of the engagement portion and the displacement hindering member, is effected for effecting co-operative disposition of the displacement hindering member relative to the engagement portion such that displacement of the engagement portion to the retracted position is prevented, in response to the urging by the biasing member, via the force transmitter, while: (i) the one of the engagement portion and the displacement hindering member, that is being displaced, is engaged to the first pusher, and (ii) the biasing member is disposed for releasing energy for effecting the urging.

50. The locator as claimed in claim 49;

wherein the displacement of the one of the engagement portion and the displacement hindering member, relative to the other one of the engagement portion and the displacement hindering member, with effect that the engagement portion and the displacement hindering member become co-operatively disposed such that the displacement of the engagement portion to the retracted position is prevented, is effected while the engagement portion displaceable between the locating and retracted positions.

51. The locator as claimed in claim 33;

wherein the unitary body of the wellbore coupler is defined by a collet.

52. The locator as claimed in claim 33;

wherein the engagement portion and the displacement hindering member are co-operatively configured such that overcoming the bias of the displacement hindering member is with effect that the displacement hindering member is disposed relative to the engagement portion such that the engagement mcmbcr portion is displaceable to the retracted position.

53. A locator comprising:

a wellbore coupler that defines a unitary body including an engagement portion and a biasing portion, wherein the biasing portion is for biasing the engagement portion towards a locating position for disposition within a locate profile, and configured for displacement between the locating position and a retracted position;

a displacement hindering member that is biased to disposition relative to the engagement member for impeding displacement of the engagement portion to the retracted position;

wherein the engagement portion and the displacement hindering member are co-operatively configured such that:

the engagement portion and the displacement hindering member are displaceable relative to one another, while the displacement of the engagement portion to the retracted position is being impeded, for effecting a change in condition of the engagement portion such that the engagement portion becomes displaceable to the retracted position; and overcoming of the bias of the displacement hindering member relative to the engagement portion for effecting the preventing of the displacement of the engagement portion to the retracted position is effected by urging of the displacement hindering member by the engagement portion during displacement of the engagement portion from the locating position to the retracted position.

54. The locator as claimed in claim 53;

wherein the unitary body of the wellbore coupler is defined by a collet.

55. The locator as claimed in claim 53;

wherein the engagement portion and the displacement hindering member are co-operatively configured such that overcoming the bias of the displacement hindering member is with effect that the displacement hindering member is disposed relative to the engagement portion such that the engagement portion is displaceable to the retracted position.

56. A locator comprising:

a wellbore coupler including an engagement member that is biased for becoming disposed in a locating position within a locate profile within a wellbore;

a displacement impeding member configured for disposition in a first position, wherein, in the first position, the displacement impeding member is supporting the engagement member and impeding retraction of the engagement member from the locate profile;

wherein:

the displacement impeding member is biased to the first position;

the engagement member and the displacement impeding member are co-operatively configured such that:

the displacement impeding member is displaceable, relative to the engagement member, to a second position, with effect that the engagement member becomes displaceable to a retracted position; and overcoming of the bias of the displacement impeding member relative to the engagement member for effecting the impeding of the retraction of the engagement member is effected by urging of the displacement impeding member by the engagement member during retraction of the engagement member from the locating position.

57. The locator as claimed in claim 56:

wherein the displacement of the displacement impeding member from the first position to the second position is such that obstruction, by the displacement impeding member, of the retraction of the engagement member from the locate profile, is defeated.

58. The locator as claimed in claim 56;

wherein the impeding displacement is effected while the engagement member is engaged to the displacement impeding member.

59. The locator as claimed in claim 58;

wherein the impeding displacement is effected while the engagement member is seated on the displacement impeding member.

60. The locator as claimed in claim 59;

further comprising:

a conveyance member for coupling to a workstring for effecting movement of the locator within a wellbore;

wherein:

the engagement member is disposed in a locating position while disposed within the locate profile;

the engagement member is displaceable between the locating position and the retracted position; and the displacement of the engagement member, between the locating and retracted positions, is along an axis that is transverse to the central longitudinal axis of the conveyance member.

61. The locator as claimed in claim 56;

wherein the engagement member and the displacement impeding member are co-operatively configured such that overcoming the bias of the displacement impeding member is with effect that the displacement impeding member is disposed relative to the engagement member such that the engagement member is retractable from the locate profile.

* * * * *